US006813465B2

(12) United States Patent
Kishimoto et al.

(10) Patent No.: US 6,813,465 B2
(45) Date of Patent: Nov. 2, 2004

(54) FLASH FIXING DEVICE AND A PRINTING DEVICE USING THE FLASH FIXING DEVICE

(75) Inventors: Teruki Kishimoto, Kawasaki (JP); Akira Iwaishi, Kawasaki (JP); Tomokazu Akuta, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/309,088

(22) Filed: Dec. 4, 2002

(65) Prior Publication Data

US 2003/0231909 A1 Dec. 18, 2003

(30) Foreign Application Priority Data

Jun. 14, 2002 (JP) ..... 2002-174613

(51) Int. Cl.[7] ..... G03G 15/20
(52) U.S. Cl. ..... 399/336; 219/216
(58) Field of Search ..... 399/335, 336; 219/216, 220, 388; 432/59; 347/156

(56) References Cited

U.S. PATENT DOCUMENTS 4,183,654 A 1/1980 Waschk et al. ..... 399/91
4,386,840 A 6/1983 Garthwaite et al. ..... 399/337
4,766,288 A 8/1988 Berkes et al. ..... 219/216
4,782,362 A * 11/1988 Mitsuya et al. ..... 399/337
5,448,344 A * 9/1995 Itakura et al. ..... 399/336
5,521,689 A * 5/1996 Miyakoshi ..... 399/336

FOREIGN PATENT DOCUMENTS

JP 54-151849 * 11/1979
JP 59-104680 6/1984
JP 62-161183 7/1987
JP 6-308852 11/1994

* cited by examiner

*Primary Examiner*—Sophia S. Chen
(74) *Attorney, Agent, or Firm*—Westerman, Hattori, Daniels & Adrian, LLP

(57) ABSTRACT

A new flash fixing device configured to fix a toner image by a flash light is presented. This flash fixing device includes a plurality of flash lamps arranged parallel to each other, and a reflection board including a plurality of side part reflection surfaces each facing from a side to the respective flash lamps. In a case where a surface including two central axes of the two flash lamps arranged one at each end is defined as a standard surface, an acute angle against the standard surface is set to be decreased as the side part reflection surface is positioned closer to a center of the arrangement of the plurality of the flash lamps.

16 Claims, 22 Drawing Sheets

FIG.8

| | | | | | | | | | |
|---|---|---|---|---|---|---|---|---|---|
| UNEVENNESS OF MELT ENERGY | −15% | −9% | −7% | −5% | 0 | +5% | +7% | +9% | +15% |
| UNEVENNESS OF LIGHT AND SHADE OF PRINTING | −15% | −9% | −7% | −5% | 0 | +5% | +7% | +9% | +15% |
| SUBJECTIVE EVALUATION | × | × | ○ | ○ | ○ | ○ | ○ | × | × |

FLASH FIXING DEVICE AND A PRINTING DEVICE USING THE FLASH FIXING DEVICE

BACKGROUND OF THE INVENTION

1. Field of the Invention

The present invention generally relates to flashing fixing devices wherein toners on media are fixed by flash lights and printing devices using the flash fixing devices. More particularly, the present invention relates to a flash fixing device, by which an unevenness of a light(brightness) and a shade(darkness) of a half tone picture can be reduced so that a toner image having a high resolution can be fixed, and a printing device using the flash fixing device.

2. Description of the Related Art

In the field of a printer forming a toner image using an electronic picture method or the like, a picture is formed on a printing medium by a powder toner. Hence, the powder toner on the printing medium is melted so as to fix the toner image. It is necessary for fixing the toner image to give fixing energy to the printing medium, for example.

In the field of high speed printers, a non-contact type fixing method is used for giving fixing energy. The non-contact type fixing method is proper for fixing the toner image of a high speed printer because high fixing energy can be given without adversely affecting the conveyance of the printing medium.

As a non-contact type fixing method, a flash fixing method, in which the flash light of a flash lamp is used, has been used. It is possible to fix the toner image in every designated area of the printing medium, by the flash fixing method wherein the flash lamp emits light with a designated time interval as corresponding to the conveyance of the printing medium.

In the above mentioned flash fixing method, it is efficient to fix the toner image for the designated area of the printing medium using one flash emission. However, generally, the emission energy distribution of the flash light is not uniform throughout the designated area of the printing medium. Therefore, the flash light is double-strikes (emits light twice) to a part of the designated area of the printing medium.

With regard to the double-striking of the flash light, there is related art to achieve a proper emission energy distribution and a proper double-strike area so as to avoid a fixing unevenness of a toner image, as disclosed in the Japanese Patent 2870705 or the Japanese Laid-Open Patent Application, No. 6-308852.

However, according to the above mentioned related art, in order to prevent the dispersion of a fixing ratio of the toner, the change of the emission energy distribution is controlled. That is, the above mentioned related art inventions have problems in that the emission energy in an entire area of a printing medium has to be controlled so as to have a higher value than a sufficient value to fix the toner and a lower value than an excessive value to cause the toner to be ruptured.

In the meantime, recently, it has been required to print not only a character but also a half tone picture, especially to print with a high resolution. In a case of printing with a high resolution such as 600 dpi, for example, as shown in FIG. 1, it is necessary to fix a toner having a smaller dot size than the dot size of a low resolution such as 240 dpi.

To improve such a high resolution, a difference of a dot diameter size after the toner is fixed becomes a problem. More particularly, in a case where the emission energy is given, the toner in the dot is melted so as to go out from the periphery of the primary dot. An area in the part where the toner goes out from the periphery of the dot, the going out area, varies based on the difference in the amount of the emission energy provided.

FIG. 1 is a view for explaining a cause an unevenness of light and shade that is a problem of the related art. As shown in FIG. 1, in a case where the emission energy is small, the going out area is small. In a case where the emission energy is large, the going out area is large. The above mentioned difference of the going out areas does not stand out in a case where the high resolution is approximately 240 dpi.

However, in a case where the high resolution of approximately 600 dpi, the size of the dot becomes less than a half size. Hence, a difference of the size of a dot diameter after fixing the toner does stand out because of the difference of the going out areas. Particularly, in a case of a half tone picture, there seems to be a different graduation resulting despite the same graduation originally.

In the above mentioned related art, the emission energy distribution sufficient to fix the toner is given to the continuous-form medium. Accordingly, with regard to the emission energy having a higher value than the above mentioned fixing energy, only the explosion of the toner is considered. However, the unevenness of light and shade after fixing based on the emission energy is not considered.

That is, in the related art, the emission energy distribution of the flash, a fixing width, and a duplicate width are determined so as to prevent unevenness of fixing. The change of the emission energy having a higher value is not considered. Therefore, it is difficult to prevent the unevenness of light and shade in high resolution printing.

Furthermore, an important property of the emission energy distribution by one time flash emission is the unevenness of light and shade, which can be prevented by duplicating the flash light plural times. That is, if property of the emission energy distribution by the one time flash emission is made proper, it is possible to prevent the unevenness of light and shade and to reduce emission frequency and energy consumption in a case where the double-strike area is reduced. In a case of an application wherein plural flash lamps are used, it is necessary to control the orientation of a light from the plurality of the flash lamps. Hence, it is difficult to realize an emission energy distribution that can prevent not only the fixing unevenness but also the unevenness of light and shade.

SUMMARY OF THE INVENTION

Accordingly, it is a general object of the present invention to provide a novel and useful flash fixing device and a printing device using the flash fixing device in which one or more of the problems described above are eliminated.

Another and more specific object of the present invention is to provide a flash fixing device having a plurality of flash lamps and a printing device using the flash fixing device so as to realize one time flash emission energy distribution that is useful in preventing not only the fixing unevenness but also the unevenness of light(brightness) and shade (darkness).

The above objects of the present invention are achieved by a flash fixing device configured to fix a toner image by a flash light, including a plurality of flash lamps arranged parallel to each other, and a reflection board including a plurality of side part reflection surfaces each facing from a side to the respective flash lamps, wherein in a case where a surface including two central axes of the two flash lamps arranged one at each end is defined as a standard surface, an acute angle against the standard surface is set to be decreased as the side part reflection surface is positioned closer to a center of the arrangement of the plurality of the flash lamps.

In the present invention, the plurality of the flash lamps may be arranged parallel to each other in a conveyance direction of a printing medium. A light emitted with a designated emission frequency by the flash lamp is reflected to an irradiation area by the reflection board. As the side part reflection surface is close to a center of an arrangement of the flash lamps, the emission energy distribution is substantially constant at a central part by setting an inclination angle (acute angle) against the standard surface small and is decreased at both end parts as having a distance from the central part. The above mentioned property of the emission energy distribution is useful in order to obtain a melt energy distribution being substantially constant in an irradiation area by overlapping the plurality of the flash lights.

The above mentioned reflection board may be a member wherein respective side part reflection surfaces and the respective upper part reflection surface are formed together with. Alternatively, the above mentioned reflection board may include a plurality of members formed independently corresponding to the plurality of the flash lamps. In addition, although the respective side part reflection surfaces of the reflection board are flat so as to manufacture the reflection board efficiently, the respective side part reflection surfaces of the reflection board may have a crooked surface and/or a curved surface.

Other object of the present invention is to provide a flash fixing device configured to fix a toner image by a flash light, including a plurality of flash lamps arranged parallel to each other, and a reflection board including a side part reflection surface and an upper part reflection surface that partially surround the flash lamp, as corresponding to the respective flash lamps, so that a light emitted by the flash lamps is reflected to an irradiation area, wherein an emission energy distribution obtained by a one time flash light of the flash lamps is substantially constant at a central part of the irradiation area and decreases gradually from the central part to both end parts of the irradiation area.

According to the present invention, it is possible to realize the emission energy distribution having a trapezoid type that is useful in order to obtain a melt energy distribution being substantially constant in an irradiation area by overlapping the plurality of the flash lights. The above mentioned irradiation area may be an area on the printing medium corresponding to an opening width between both ends of the reflection board.

Other object of the present invention is to provide a printing device configured to form a toner image of a medium carried at a designated conveyance speed, including image forming means for forming the toner image at the medium, a flash fixing device configured to fix the toner image by a flash light, including a plurality of flash lamps arranged parallel to each other, and a reflection board including a side part reflection surface facing from a side to the flash lamp as corresponding to the respective flash lamps, wherein in a case where a surface including central axes of the two flash lamps arranged one at each end is defined as a standard surface, an acute angle against the standard surface is set to be decreased as the side part reflection surface is positioned closer to a center of the arrangement of the plurality of the flash lamps.

According to the present invention, it is possible to realize uniformity of the melt energy distribution by using the fixing device realizing a property of the emission energy distribution of the trapezoid type. Hence, even in the case of a high tone picture having a high resolution, it is possible to obtain a high quality picture without unevenness of light and shade.

Other objects, features, and advantages of the present invention will become more apparent from the following detailed description when read in conjunction with the accompanying drawings.

BRIEF DESCRIPTION OF THE DRAWINGS

FIG. 8 is a view showing a relation of the unevenness of light and shade and a subjective evaluation;

DETAILED DESCRIPTION OF THE PREFERRED EMBODIMENTS

A description will now be given, with reference to the drawings, of embodiments of the present invention.

First a printing device of the present invention will be described.

Figure 2:
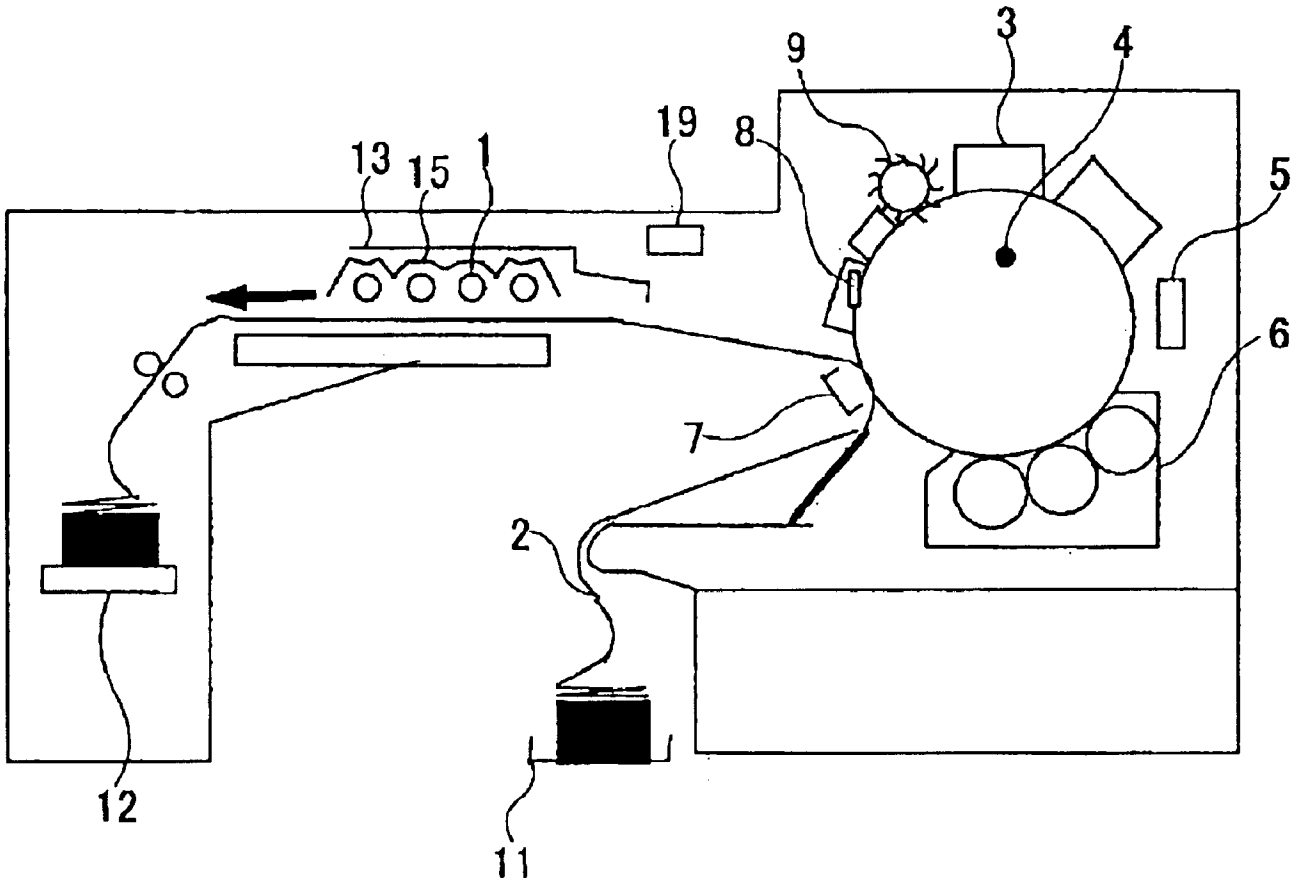
FIG. 2 is a structural view of a printing device of an embodiment of the present invention.
Figure 3:
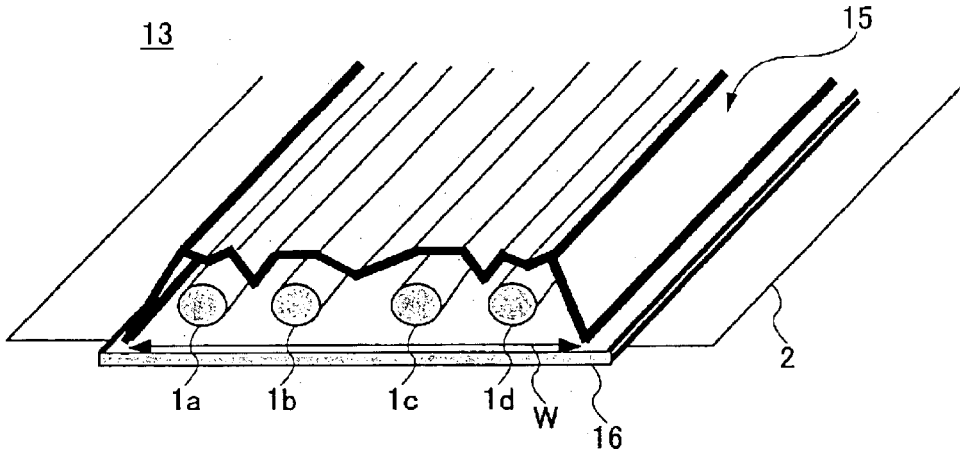
FIG. 3 is a perspective view showing a structure of a flash fixing unit 13 illustrated in FIG. 2.
Figure 4:
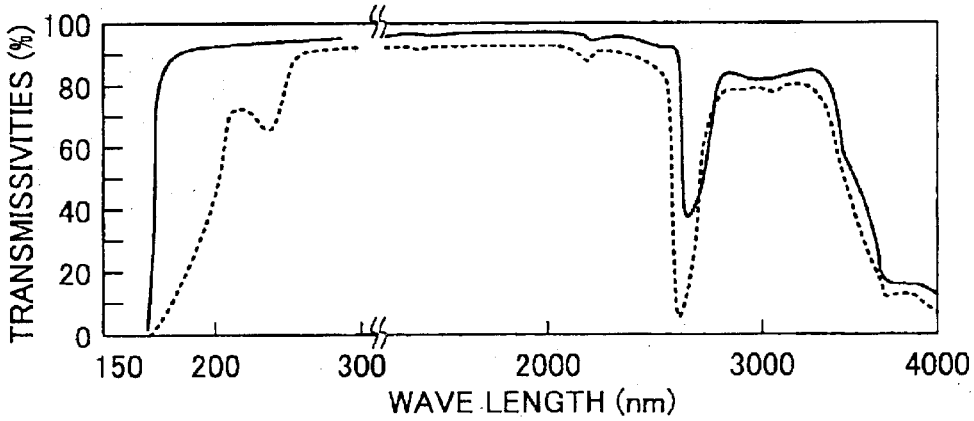
FIG. 4 is an optical property view of a light transmission plate 16 of the flash fixing unit 13 illustrated in FIG. 3.

FIG. 2 is a structural view of a printing device of an embodiment of the present invention. FIG. 3 is a perspective view showing a structure of a flash fixing unit 13 illustrated in FIG. 2. FIG. 4 is an optical property view of a light transmission plate 16 of the flash fixing unit 13 illustrated in FIG. 3.

A structure of an electronic photograph printer wherein a continuous-form paper is used as a printing device of an embodiment of the present invention is shown in FIG. 2. A continuous-form paper 2 loaded at a paper hopper 11 is carried consecutively by a conveyance system so as to be housed in a stacker 12 through a transferring device 7 and a flash fixing unit 13.

After a photo sensitive body drum 4 rotating clockwise is electrified evenly by an electrification device 3, a picture is exposed at the photo sensitive body drum 4 by an optical system 5. Because of this, an electrostatic latent image corresponding to the picture is formed at the photo sensitive body drum 4. After the electrostatic latent image formed at the photo sensitive body drum 4 is developed by a developing device 6, a toner image of the photo sensitive body drum 4 is transferred to the continuous-form paper 2 by the transferring device 7.

After the toner image of the photo sensitive body drum 4 is transferred to the continuous-form paper 2, the photo sensitive body drum 4 is de-electrified by a de-electrification device 9 and the remaining toner is cleaned by a cleaner blade 8 and a cleaner brush 10 (not illustrated). After being flash-fixed by the flash fixing unit 13, the continuous-form paper 2 to which the toner image is transferred is housed in the stacker 12. An emission (an emission frequency) of the flash lamp 1 of the flash fixing unit 13 is controlled by the flash control unit 19.

FIG. 3 is a perspective view showing a structure of the flash fixing unit 13 illustrated in FIG. 2. The flash fixing unit 13 has more than two of the flash lamps 1 (four of flash lamps 1*a* through 1*d* in this embodiment), a reflection board 15, and a light transmission plate 16. The flash lamp 1 is made of an ozone-less quartz glass tube having a cylindrical configuration and an arc length of 502 [mm]. 220 [Torr] of Xe gas is enclosed in the flash lamp 1.

The light transmission plate 16 including the glass board is provided between the flash lamp 1 and the continuous-form paper 2. A board wherein the VAD (Vapor-phase Axial Deposition) method synthetic quartz glass is used is preferable as the glass board.

FIG. 4 is an optical property view of the light transmission plate 16 of the flash fixing unit 13 illustrated in FIG. 3, namely transmissivities by emission wave lengths of the respective glass boards. In FIG. 4, a dotted line shows the transmissivity of a related art torch fused silica glass and a solid line shows the transmissivity of VAD method synthetic quartz glass. The transmissivity of VAD method synthtic quartz glass in the infrared light area (the vicinity of 2000 nm) is improved so as to contribute to an improvement of the fixing ability against a toner having absorption for the infrared light area.

Referring to FIG. 3 again, the reflection board 15 is provided so as to cover the flash lamp 1 (1*a*, 1*b*, 1*c*, and 1*d*). The reflection board 15 is opened against the light transmission plate 16 with an opening width W. A light emitted by the flash lamp 1 is reflected to an irradiation area that is a designated area on the continuous-form paper 2 corresponding to the opening width W, by the reflection board 15. Hence, a reflection increasing process is implemented to the inside surface of the reflection board 15, preferably after aluminum deposition.

As described later, the reflection board 15 forms emission energy distribution in a conveyance direction of the continuous-form paper in the irradiation area so as to make substantially a trapezoid, by the one time flash emission of the flash lamp 1. Hereinafter, the emission energy distribution by the one time flash emission is called the "emission energy distribution".

Next, a determining method for an emission frequency will be described.

Figure 5:
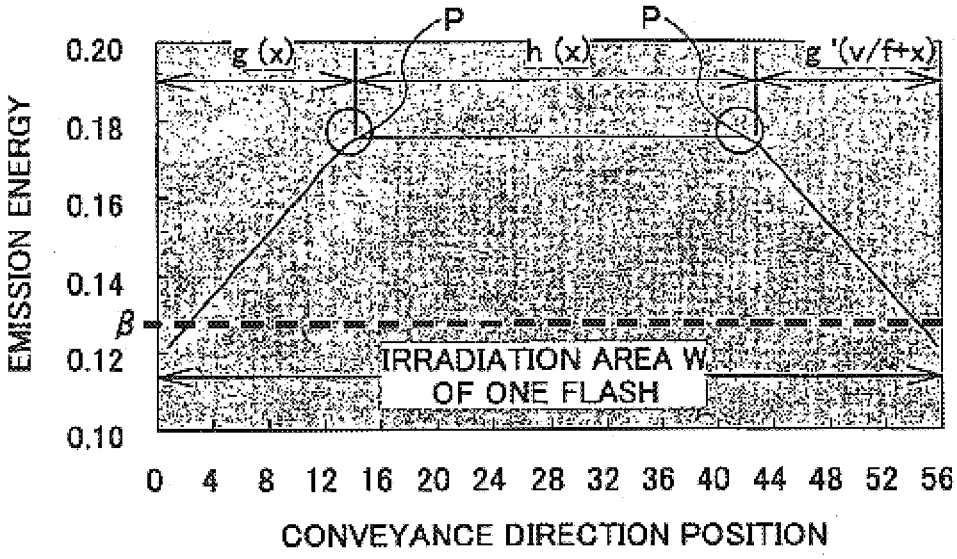
FIG. 5 is a model view of the emission energy distribution by the one time flash of the flash fixing device 13 illustrated in FIG. 3.

FIG. 5 is a model view of the emission energy distribution by the one time flash of the flash fixing device 13 illustrated in FIG. 3.

Figure 6:
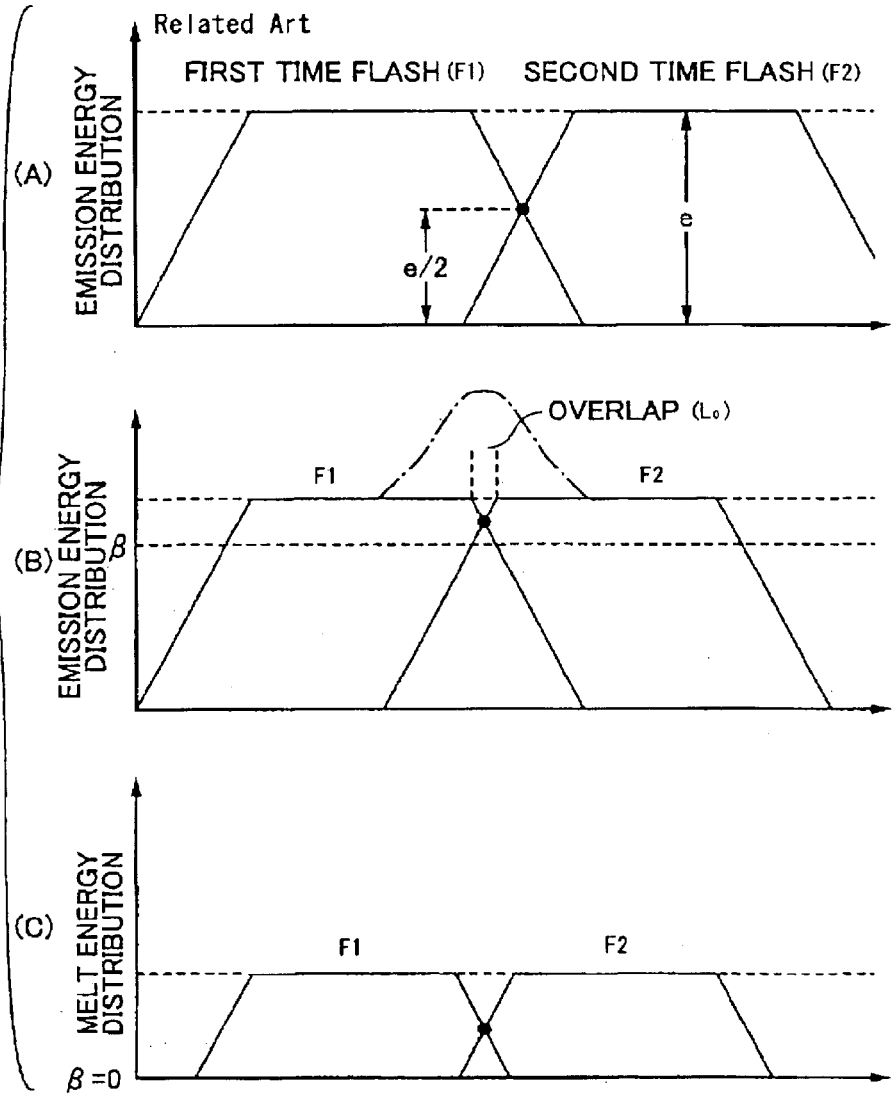
FIG. 6 is a view for explaining the determining method for the emission frequency of the flash fixing device 13.

FIG. 6 is a view for explaining the determining method for the emission frequency of the flash fixing device 13. More particularly, FIG. 6-(A) is a view for explaining an overlapping method of the flash light according to the related art, FIG. 6-(B) is a view for explaining an overlapping method of the flash light according to the present invention, and FIG. 6-(C) is a view for explaining a uniformity of melting energy according to the overlapping method of the flash light of the present invention.

As shown in FIG. 5, a model of the emission energy distribution of the present invention is a property having a substantially constant h(x) at a center part (a center part in an irradiation area of one flash) and g(x) and g' (V/f+x) reducing as separating from an end part P of the center part to both sides. Here, "v" represents a conveyance speed of the continuous-form paper 2, "f" represents a flash emission frequency, and "V/f" represents a moving distance of the continuous-form paper 2, namely an area where the one time flash light is applied, during the one time flash emissions.

Next, energy for starting a non-reversible change of the condensed matter of the toner, that is the minimum energy required to fix the toner to the sheet, is defined as a starting fixing energy β. The starting fixing energy β is calculated by a correlation of the emission energy and the density after flash fixing.

Figure 7:
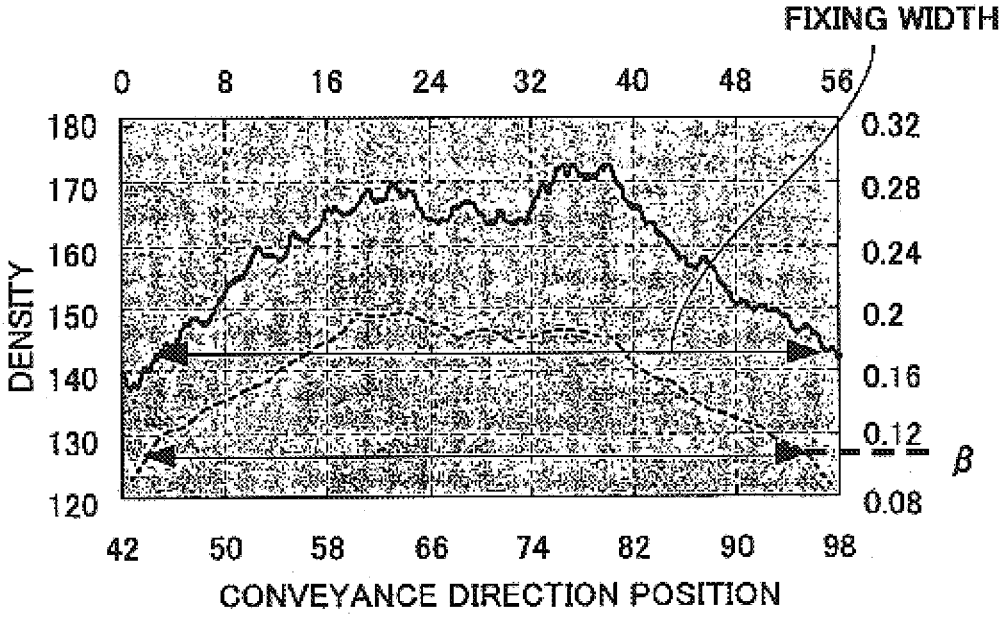
FIG. 7 is a view showing a relation of the emission energy distribution and a printing density.

FIG. 7 is a view showing a relation of the emission energy distribution (illustrated by a doted line) and printing density (illustrated by a solid line). For instance, after a uniform half tone toner image that is 1on-1off in a case of 600 dpi resolution is flash fixed in a setting of an emission frequency where the flash light is not overlapped, a tape is stuck on the toner image at a constant pressure. After that, the tape is peeled off the toner so that the fixing width is measured by the toner fixed. The minimum emission energy in the fixing width is the starting fixing energy β.

Next, the energy at an overlapped part by overlapping the flash light is calculated with consideration of the starting fixing energy β.

Inventors of the present invention recognized that after the emission energy having a higher value than the starting fixing energy β is given by the one time flash, light and shade is determined based on an amount of the emission energy having a higher value than the starting fixing energy β of the second time flash. Based on the above mentioned recognition, the energy at the overlapped part is calculated by the following formula (1).

Energy at the overlapped part=Energy before overlapped+(Energy to be overlapped−β) (1)

In a case where the value of the (Energy to be overlapped−β) is less than 0(zero), the energy at the overlapped part is calculated by replacing the (Energy to be overlapped−β) with 0(zero).

The length $L_0$ of the overlapped part is calculated by the following formula (2) with the opening width W of the reflection board 15.

$$L_0=W-v/f \quad (2)$$

In a case where the energy at the overlapped parts is equal to the energy h(x) at the center part, a completely flat melt energy distribution can be obtained. That is, in a case where the following formula is built, ideal and completely flat consecutive melt energy distribution can be obtained.

$$g(x)+g'(V/f+X)-\beta=h(x) \quad (3)$$

According to the related art, as shown in FIG. 6-(A), overlapping is attempted so as to cross the first time flash light F1 and the second time flash light F2 with a half of a maximum value e of the emission energy, namely e/2, in order to make the emission energy distribution flat. However, it is not possible to prevent unevenness of light and shade even if the emission energy distribution is made flat. That is, the density in the overlapped part is lower than the center part.

Figure 1:
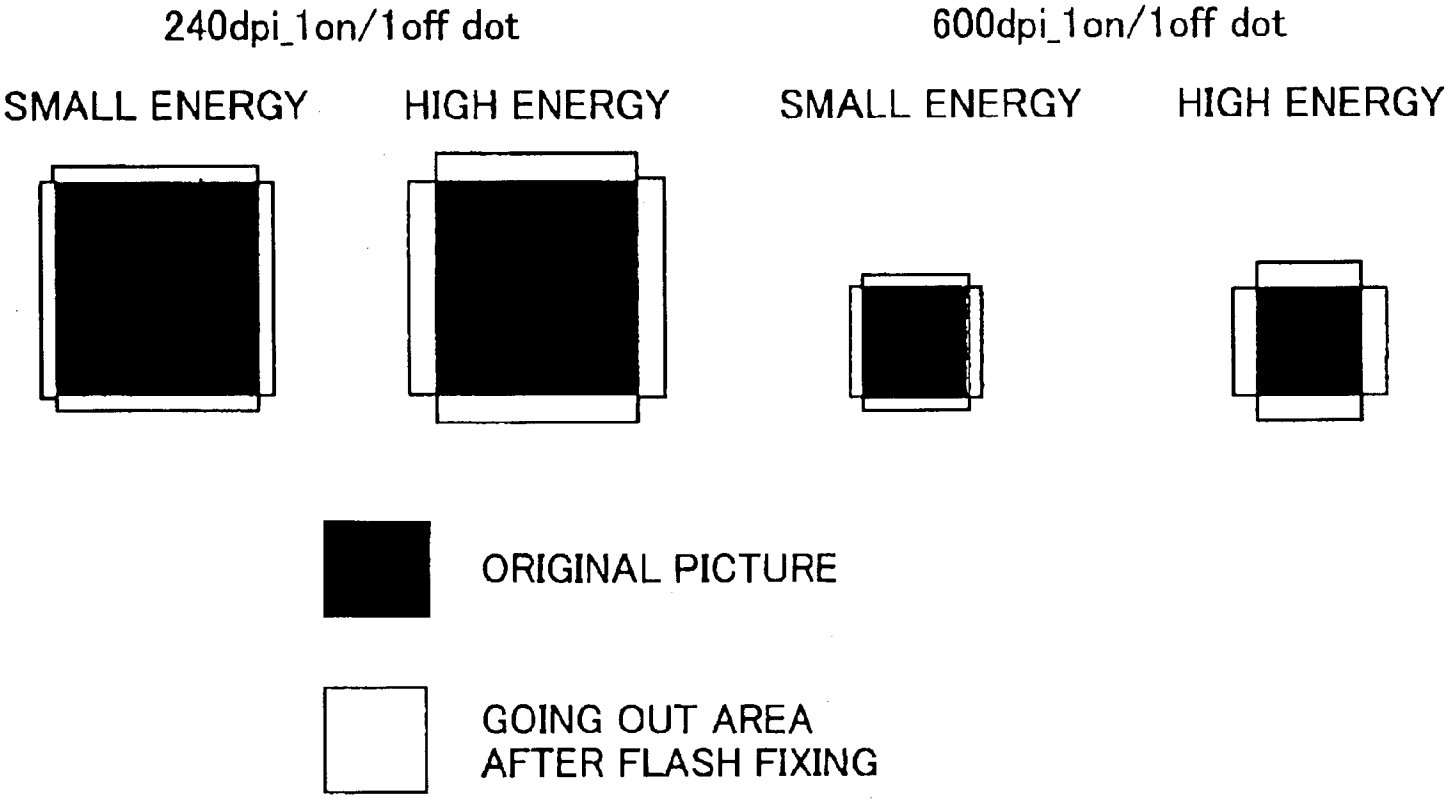
FIG.1 RELATED ART
FIG. 1 is a view for explaining a cause of an unevenness of light and shade that is a problem of the related art.

According to the present invention, the toner is not fixed in a case where the toner has an energy having a value less than the fixing starting energy (See FIG. 5). However, once the fixing starting energy is given, the going out area shown in FIG. 1 is determined by the amount of the emission energy greater than the fixing starting energy.

In the present invention, the emission energy distribution of the flash part and the overlapped part is not made flat. But, a distribution of melt energy, namely energy having a value more than the fixing starting energy influencing the light and shade (going out area) is made flat.

Because of this, the fixing starting energy β is added as conditions for overlapping. That is, as shown in FIG. 6-(B), a cross energy where a first time flash light F1 and a second time flash light F2 cross is made higher than the fixing starting energy β. Furthermore, as shown in FIG. 6-(C) and represented by the formula (1), the distribution of the melt energy higher than the fixing starting energy is made flat.

Therefore, as illustrated by a dotted line in FIG. 6-(B), the emission energy of the overlapped part is different from the central part of the emission energy. That is, the distribution of the emission energy is not made flat. However, as shown in FIG. 6-(C), the melt energy is made flat so that the light and shade is prevented.

However, generally, it is difficult to realize the ideal distribution of the melt energy due to a difference of a configuration and precision of the reflection board, a positioning precision of the flash lamp, the emission energy, or the like, for example. Because of this, in the present invention, the ideal distribution of the melt energy is easily realized, by operator's determination regarding an area recognized as the unevenness of light and shade and easing of the conditions of the formula (3).

FIG. 8 is a view showing a relation of the unevenness of light and shade and a subjective evaluation. The relation between nine samples obtained by varying the emission frequency and the subjective evaluation is shown in FIG. 8. In the respective samples, the unevenness of light and shade is different. The unevenness of light and shade is calculated by the following formula based on a scanner output value of the fixing result.

Unevenness of light and shade=[Output value of one flash part (Emission central part)−Output value of overlapped part]/Output value of one flash part (Emission central part)

The subjective operation is implemented by showing the samples to 20 people selected randomly and evaluated for five points. In a case where there is no unevenness at all, a point 5 is given. In a case where the unevenness stands out, a point 1 is given. In a case where, points more than 3.5 are given as an average, it is determined that there is no unevenness (○). In a case where, point less than 3.5 are given as an average, it is determined that there is unevenness (X). The unevenness of the melt energy is the same as the value of the unevenness of light and shade.

If the unevenness of light and shade of the result of printing is over ±7% and the unevenness of the melt energy is over ±7%, the unevenness of light and shade stands out so that an unacceptable result of the subjective evaluation is obtained. The unevenness of the melt energy less than ±7% is acceptable.

As a result of the subjective evaluation by the operators, the formula (3) can be eased to the formula (4), wherein H is defined as a central value of the h(x).

$$g(x)+g'(v/f+x)-\beta=H\pm 7\% \quad (4)$$

That is, in the present invention, an overlapped width (namely, based on the emission frequency of the flash lamp and the conveyance speed) is determined by the flash fixing device using the reflection board 15 wherein the emission energy distribution at the central part is substantially constant, so that the melt energy overlapped in the overlapped part is substantially the same as the melt energy at the central part. In the structure shown in FIG. 2, the conveyance speed v is predetermined. Hence, the emission frequency f of the flash lamp 1 controlled by the flash control unit 19 is set so as to satisfy the formula (4).

Energy efficiency is implemented by setting the minimum value of the emission energy at the central part (one time flash part) equal to the value of β. In a case where the minimum value is higher than the value of β, the energy is excessive so that use of energy is not efficient. However, it is possible to make the energy proper by decreasing the flash voltage of the flash lamp 1 so that the minimum value of emission energy is substantially same as the value of β.

Meanwhile, the central part (one time flash part) of the emission energy distribution is set so as to comprise a ±7% area wherein the central value H is the center. The overlapped part is set to both end parts that are areas other than the central part in the emission energy distribution. Therefore, in a case where the part belonging to the ±7% area, namely the length of the central part, can be made as large as possible, the emission frequency satisfy the formulation (4) is made small so that the consumption of energy can be reduced.

Next, with reference to FIGS. 3, 9, and 10, the structure of the reflection board 15 of the present invention that can realize the trapezoid type one time emission energy distribution will be described.

Figure 9:
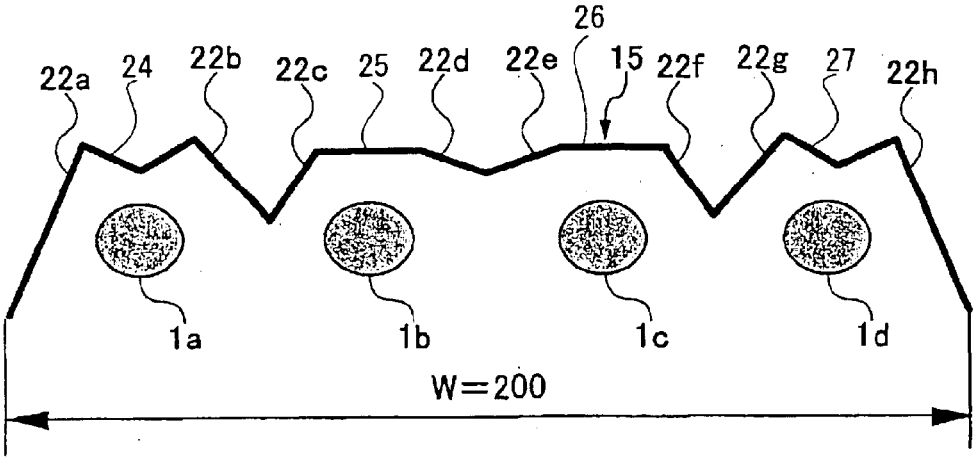
FIG. 9 is a schematic cross sectional view of the reflection board 15 as shown in FIG. 2.

FIG. 9 is a schematic cross sectional view of the reflection board 15 as shown in FIG. 2. FIG. 10 is an expanded view of the reflection board 15 shown in FIG. 3 and for explaining an orientation control of the reflection board 15. In FIG. 10, the reflection board 15 is line-symmetrical and thereby only half part of the reflection board 15 is illustrated.

The reflection board 15 of this embodiment, as shown in FIG. 3, covers four flash lamps 1*a*, 1*b*, 1*c* and 1*d*. The reflection board 15 is open to the light transmission plate 16 with the opening width W. More particularly, as shown in FIGS. 9 and 10, the reflection board 15 includes a side surface board 22*a*, a top surface board 24, and a side surface board 22*b* against the flash lamp 1*a*, a side surface board 22*c*, a top surface board 25, and a side surface board 22*d* against the flash lamp 1*b*, a side surface board 22*e*, a top surface board 26, and a side surface board 22*f* against the flash lamp 1*c*, and a side surface board 22*g*, a top surface board 27, and a side surface board 22*h* against the flash lamp 1*d*.

The side surface boards 22*a* through 22*h* and the top surface boards 24 through 27 extend along the central axis of the flash lamp 1 as shown in FIG. 3. In addition, the side surface boards and the top surface boards that are adjacent to each other, and the two side surface boards that are adjacent to each other may be separated from each other by a space due to the radiation of heat.

The reduction property at the above described overlapped part can be realized by the side surface boards 22*a* and 22*h* situated at respective ends of the reflection board 15. The flat property at the above mentioned central part can be realized by the side surface boards 22*b* through 22*g* dividing the emissions of respective flash lamps 1*a* through 1*d*.

Figure 10:
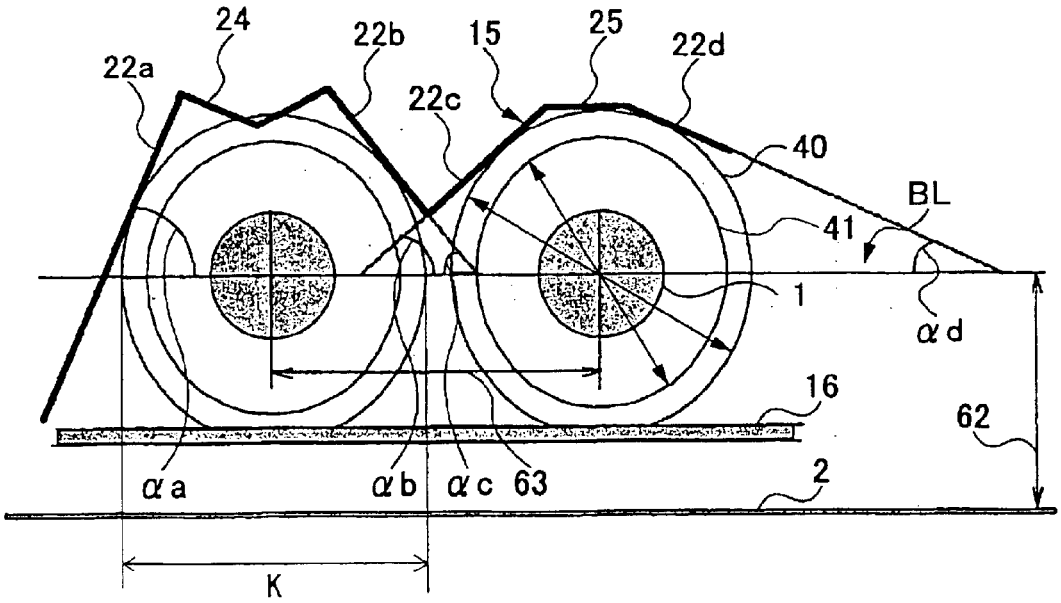
FIG. 10 is an expanded view of the reflection board 15 shown in FIG. 3 and for explaining an orientation control of the reflection board 15.
Figure 11:
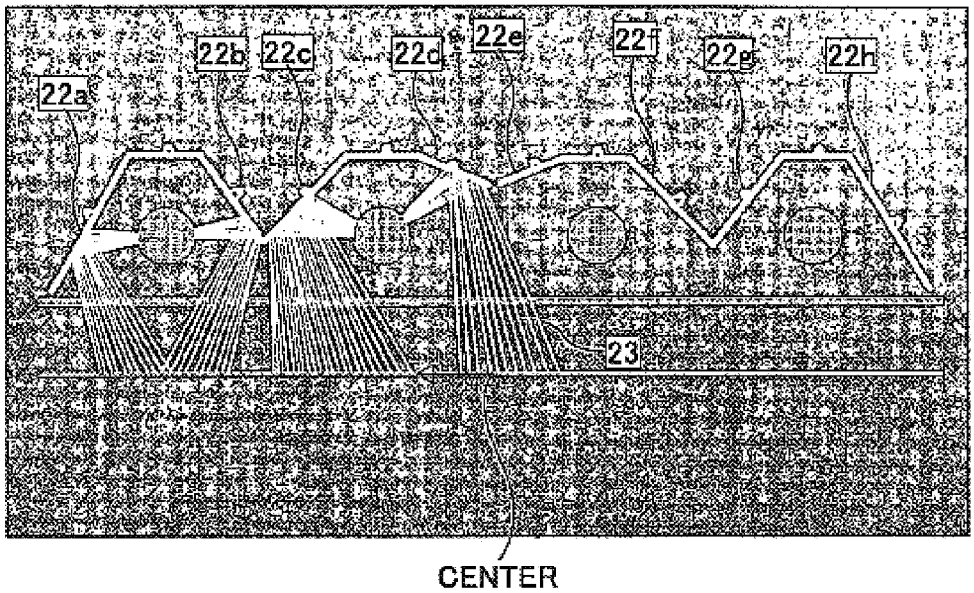
FIG. 11 is a view for explaining a light control by setting an inclination angle of the reflection board of the present invention.

FIG. 11 is a view for explaining light control by setting an inclination angle of the reflection board of the present invention. The inclination angles as indicated in FIG. 10 of the side surface boards 22*a* and 22*h* situated at respective ends of the reflection board 15 is set large, as shown in FIG. 11, so as to realize a desirable reduction property considering the overlap of the emission energy, so that the light 23 is gathered directly under the flash lamps 1*a* and 1*d* situated at both ends of the reflection board 15. Furthermore, the closer to the central side a side surface is, the smaller the inclination angle is set, so that the light 23 is spread widely and equally.

That is, acute angles $\alpha_a$ through $\alpha_h$ formed by a standard line BL, namely the line connected between the center of the flash lamp 1*a* and the center of the flash lamp 1*d*, and the side surface boards 22*a* through 22*h* are set according to the following relation (See FIG. 10.).

$$\alpha_a>\alpha_b>\alpha_c>\alpha_d,\ \alpha_h>\alpha_g>\alpha_f>\alpha_e$$

It is preferable that the acute angles $\alpha_a$ and angles $\alpha_h$ regarding the side surface boards 22*a* and 22*h*, respectively, are in a range of 63°±4°, the acute angles $\alpha_b$ and angles $\alpha_g$ regarding the side surface boards 22*b* and 22*g* are in a range of 53°±3°, the acute angles $\alpha_c$ and angles $\alpha_f$ regarding the respective side surface boards 22*c* and 22*f* are in a range of 42°±4°, and the acute angles $\alpha_d$ and angles $\alpha_e$ regarding the respective side surface boards 22*d* and 22*e* are in a range of 21°±11°.

The top surface boards 24 and 27 corresponding to the flash lamps 1*a* and 1*d* situated at respective ends of the reflection board 15 have a cross section seen from the central axis of the flash lamps 1*a* and 1*d* of a concave configuration. It is possible to shift the position of the reduction property of the emission energy distribution shown in FIG. 4, namely an ending position of the central part of the emission energy distribution by the convex configuration, so as to increase the range of the central part (one flash part) of the emission energy distribution.

It is preferable that the side surface boards 22 of the reflection board 15, as shown in FIG. 10, be positioned so as to circumscribe the flash lamp circle 40 having the same center as the center of the cross section of the flash lamp 1. It is also preferable that the external diameter K of the flash lamp circle 40 be in a range defined as follows, wherein L is defined as the diameter of a safe limit circle 41 not allowing a leak discharge.

$$L<K<1.3L$$

The safe limit circle 41 depends on an external diameter of a trigger wire (not illustrated) provided along the flash lamp tube 1. It is not necessary for the flash lamp circles 40 contacting with the respective side surface boards 22*a* through 22*h* to have same external diameter K. As long as the relationship of L<K<1.3L can be formed, external diameters K of the flash lamp circles 40 of the respective side surface board 22*a* through 22*h* may be different.

If the flash lamp 1 is situated far from the continuous-form paper 2, energy efficiency is decreased. If the flash lamp 1 is situated too close to the continuous-form paper 2, un-fixed toner image comes in contact with the glass surface 16 so that clear printing of characters may be disturbed.

It is preferable that the distance 62 between the center of the flash lamp 1 and the continuous-form paper 62 be set as 26 through 32 mm. In addition, it is not necessary for the respective flash lamps 1*a* through 1*d* to be positioned at same distance. As long as the distance 62 between the center of the flash lamp 1 and the continuous-form paper 2 is set as 26 through 32 mm, the respective flash lamps 1*a* through 1*d* may be positioned at different distances. The preferable arrangement of the flash lamp 1 is line symmetrical preferably.

If a pitch 63 of neighboring flash lamps is too short, the energy distribution is insufficient. If the pitch 63 of neighboring flush lamps is too long, the irradiation degree of the flash lamps is decreased so as to cause unevenness of the emission energy. Hence, it is necessary to set a proper pitch 63, preferably 44 through 50 mm.

Figure 12:
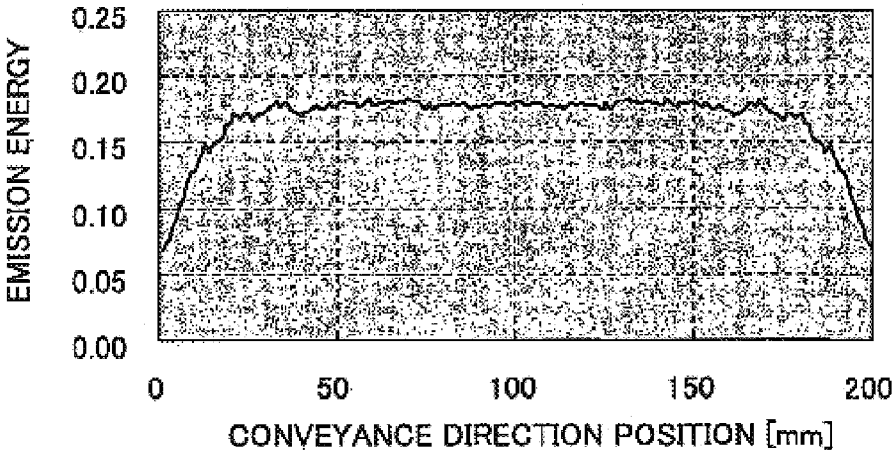
FIG. 12 is a view showing a result of the calculation of the emission energy in a case where the reflection board 15 is used, by the ray tracing according to the Mote Carlo.

FIG. 12 is a view showing a result of the calculation of the emission energy in a case where the reflection board 15 is used, by ray tracing according to the Monte Carlo method. As shown in FIG. 12, it is possible to realize an emission energy distribution having a property that the emission energy at the central part is constant at the central part and the emission energy is reduced as being far from the central part, by only the one time flash with the reflection board 15.

Figure 13:
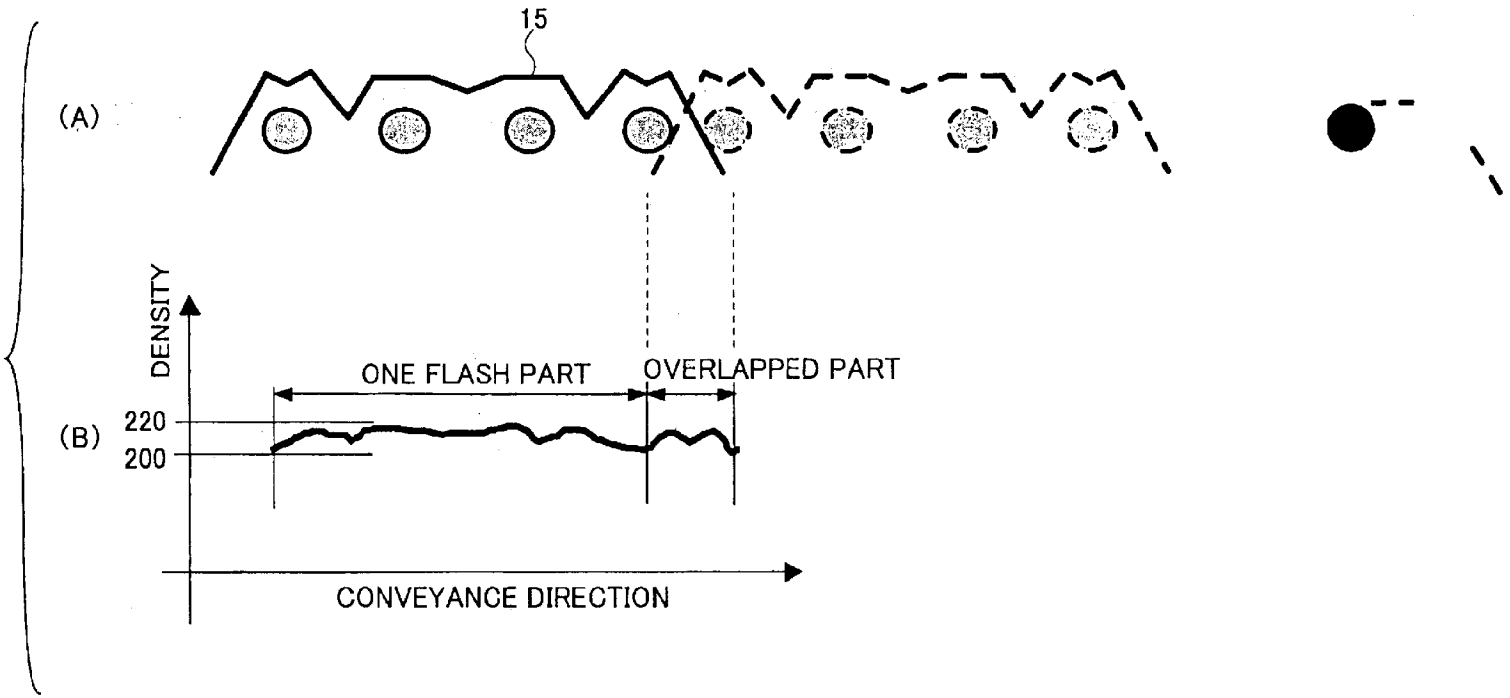
FIG. 13 is a view for explaining the printing result by the flash fixing device of the present invention.

FIG. 13 is a view for explaining the printing result by the flash fixing device of the present invention. Based on the result of the calculation shown in FIG. 12, the value of β is calculated so that the respective values are set to be satisfy formula (4). As shown in FIG. 13-(B), the measured density does not vary in a range where the output value "210" is the center so that printing having no unevenness of the light and the shade result. In FIG. 13-(A), the flash lamps 1*a* through 1*d* and the reflection board 15 are positioned as corresponding to FIG. 13-(B). In FIG. 13-(B), dotted lines show the relative positions of the flash fixing device 13 and the continuous-form paper 2 in a case of double-striking.

Figure 14:
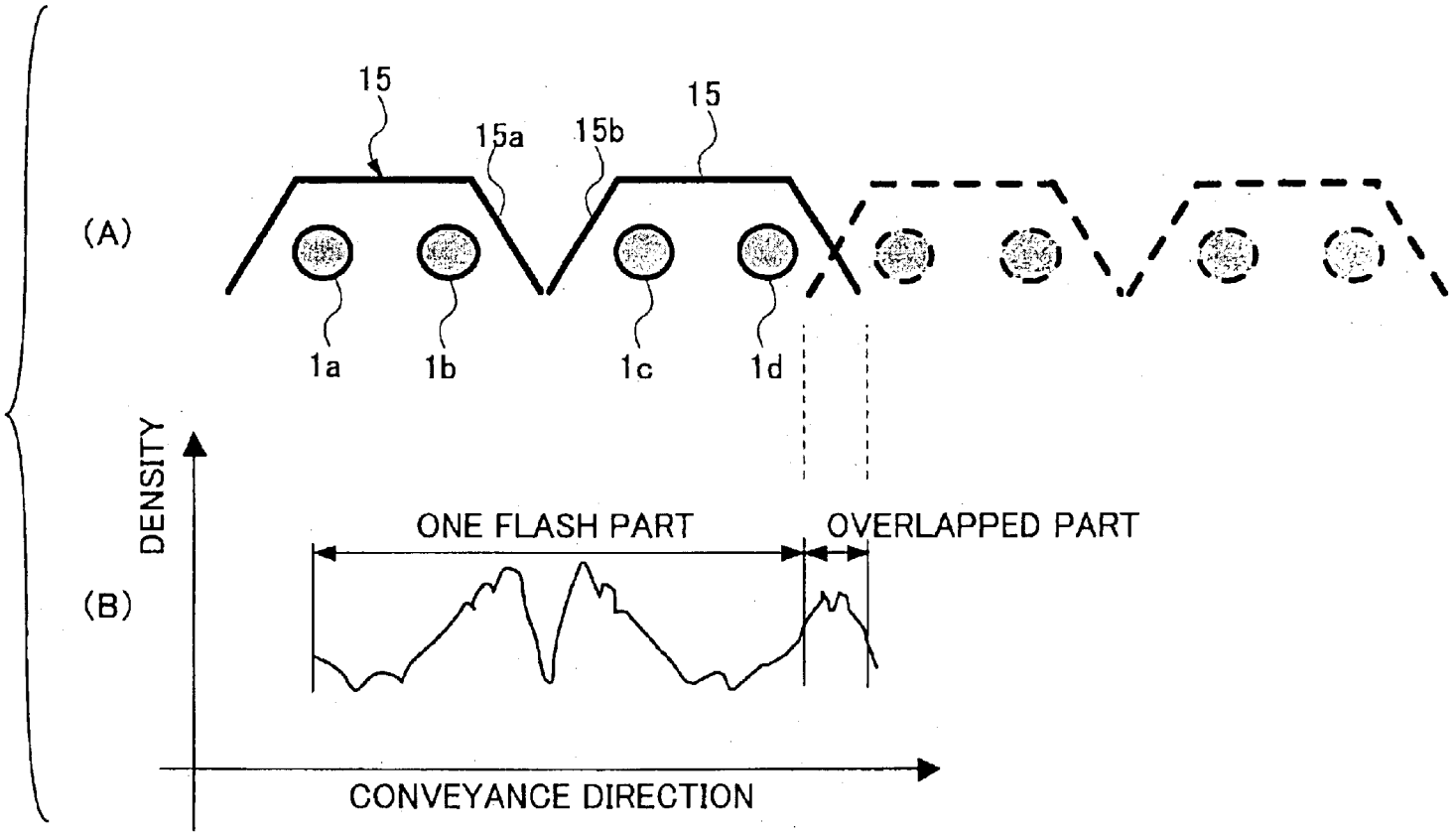
FIG. 14 is a view showing a printing result by a flash fixing device of a comparison example.
Figure 15:
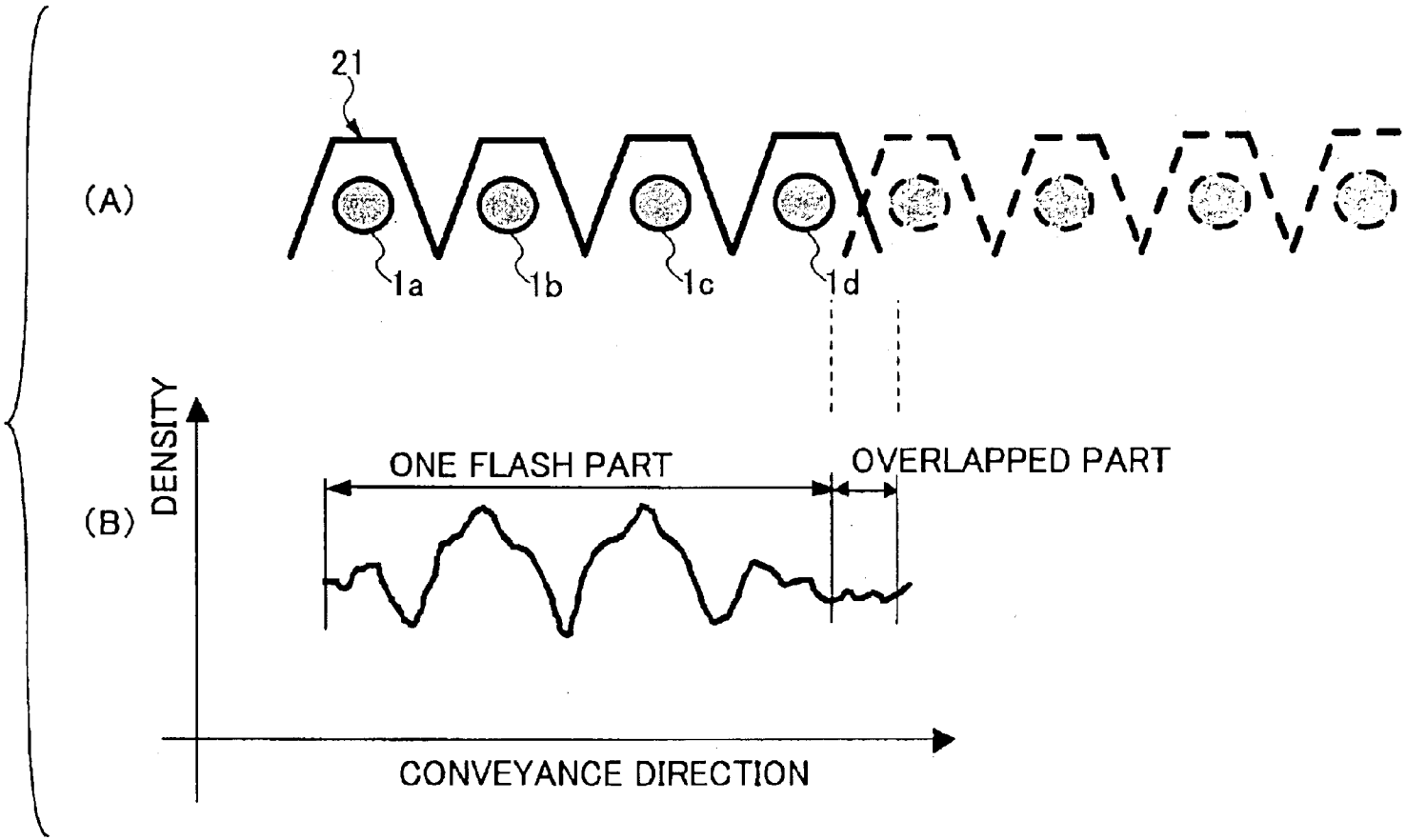
FIG. 15 is a view showing a printing result by another flash fixing device of a comparison example.

FIG. 14 is a view showing a printing result by a flash fixing device of a comparison example. FIG. 15 is a view showing a printing result by another flash fixing device of a comparison example.

As shown in FIG. 14-(B), there are various lights and shades according to the printing result, in a case where the reflection board 15, the flash lamps 1*a* through 1*d* and the continuous-form paper 2 are positioned as shown in FIG. 14-(A). That means, there is a large amount of light under the side surface board 15*a* and 15*b* at the center part and a large amount of melt energy of the toner at the overlapped part of the flash light.

Furthermore, in a case where the reflection board 21 has side surface boards having the same inclination angle as corresponding to the flash lamps 1*a* through 1*d* as shown in FIG. 15-(A), there are differences of densities between the flash lamps and directly under the flash lamps so that there is unevenness of light and shade as shown in FIG. 15-(B).

It is found that the inclination angle of the side surface board gives a large influence to the emission energy distribution and the light and the shade of the printing result, by the above mentioned result.

Meanwhile, as described above, it is preferable that the acute angles $\alpha_a$ and $\alpha_h$ regarding the respective side surface boards 22*a* and 22*h* be in a range of 63°±4°, the acute angles $\alpha_b$ and $\alpha_g$ regarding the respective side surface boards 22*b* and 22*g* be in a range of 53°±3°, the acute angles $\alpha_c$ and $\alpha_f$ regarding the side surface boards 22*c* and 22*f* be in a range of 42°±4°, and the acute angles $\alpha_d$ and $\alpha_e$ regarding the side surface boards 22*d* and 22*e* be in a range of 21°±11°. Next, a calculation result by the inventors to calculate a preferable inclination range will be described.

Figure 16:
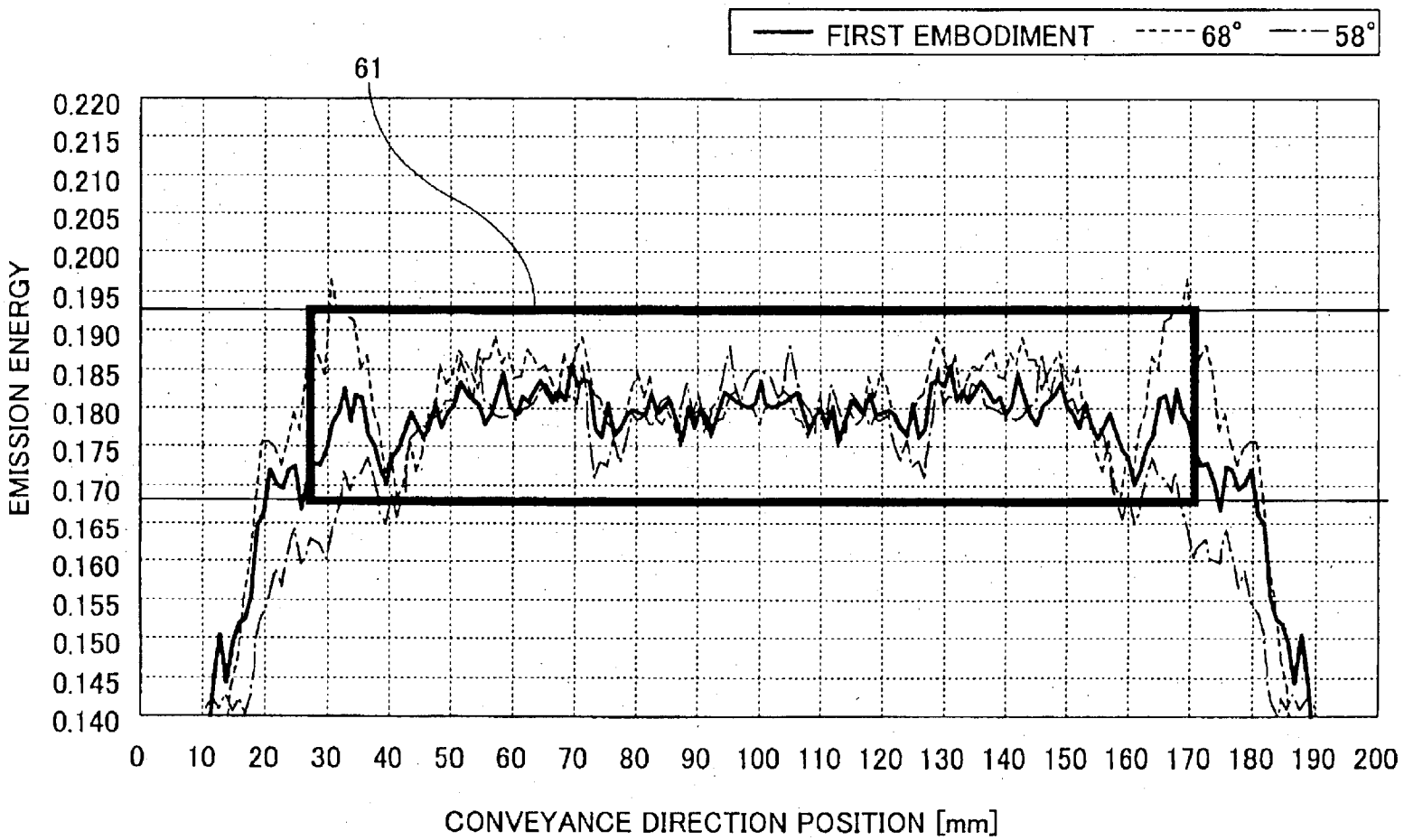
FIG. 16 is a view showing a simulation result by the Monte Carlo method of the emission energy in a case where the acute angle of the side surface board 22*a* is set as "out of the area ±1°"

FIG. 16 is a view showing a simulation result by the Monte Carlo method of the emission energy in a case where the acute angle of the side surface board 22*a* is set as "out of the area ±1°".

In FIGS. 16 through 19, an allowance area (approximately 0.168 through 0.194) of ±7% of the above mentioned formula (4) wherein the central value H (approximately 0.182) is a center is shown as an unevenness of light and shade allowance area 61 within one time flash. The central value H is calculated based on the emission energy distribution (FIG. 12) of the first embodiment. As described above, the central part (one flash part) h(x) is defined within the unevenness of light and shade allowance area 61 and the overlapped part is defined at both end parts other than the central part.

Referring to FIG. 16, the emission energy distribution of the first embodiment shown by a solid line, having a range of approximately 140 mm wherein a conveyance direction central position (100 mm) is the center, is in the above mentioned allowance area.

In the emission energy distribution (shown in a dotted line) in a case where the acute angle of the side surface board 22*a* is 68° (out of are +1°), the emission energy at vicinity (40 mm, 160 mm) of both end parts of the central part deviate from the unevenness of the light and the shade allowance area 61 in the reduction direction. In addition, the emission energy at the end parts (30 mm, 170 mm) of the central part deviates from the unevenness of the light and the shade allowance area 61 in the increasing direction. Therefore, unevenness of light and shade is generated.

In a case where the acute angle of the side surface board 22*a* is 58° (out of are −1°), in the emission energy distribution (illustrated by a one point doted line), the emission energy at vicinity (40 mm, 160 mm) of both end parts of the central part deviates from the unevenness of light and shade allowance area 61 in the reduction direction. In this case, it is possible to prevent the unevenness of light and shade by setting the emission frequency large. However, setting the emission frequency large is disadvantageous in terms of energy consumption.

Figure 17:
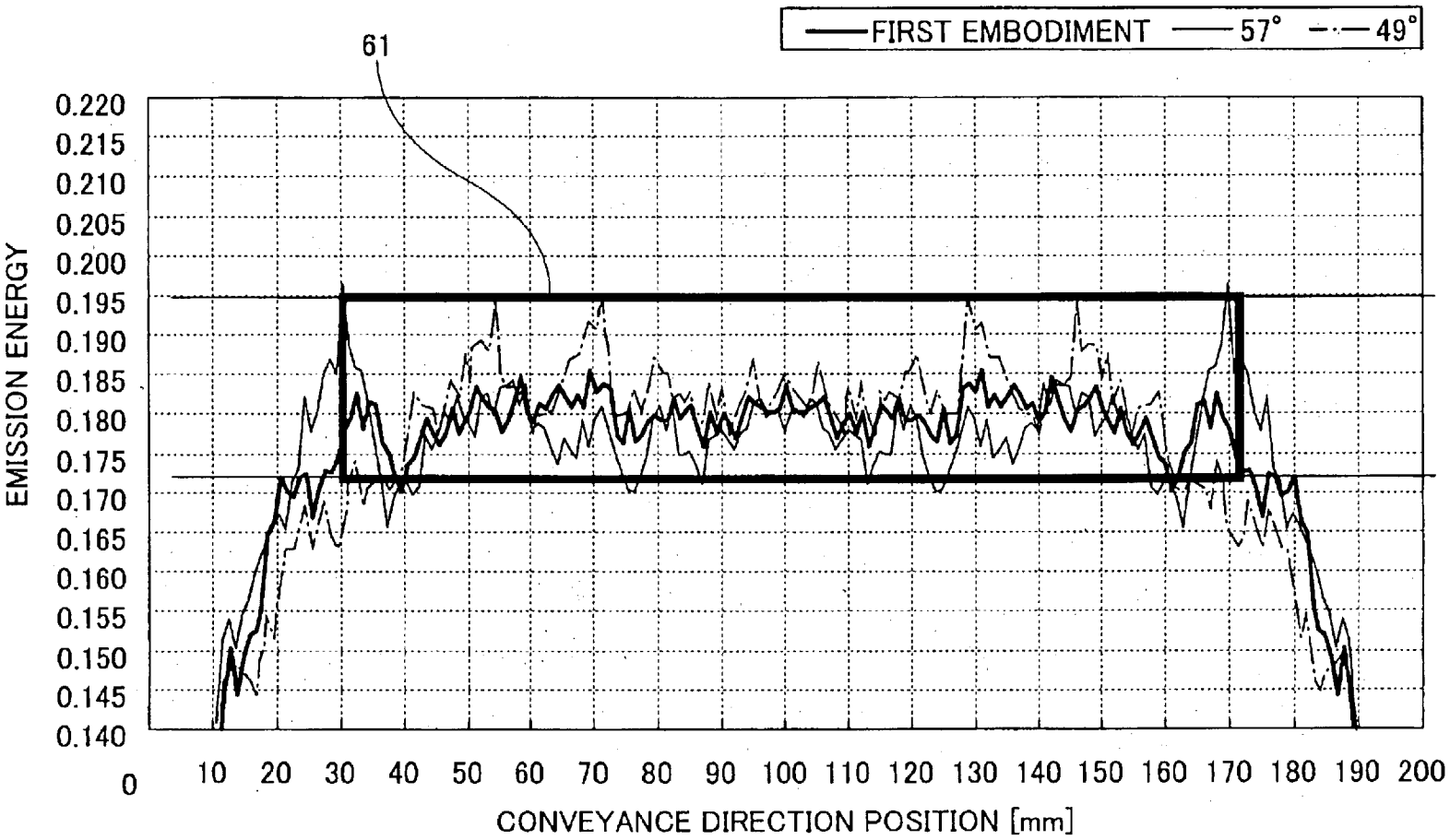
FIG. 17 is a view showing a simulation result by the Monte Carlo method of the emission energy in a case where the acute angle of the side surface board 22*b* is set as "out of the area ±1°"
Figure 18:
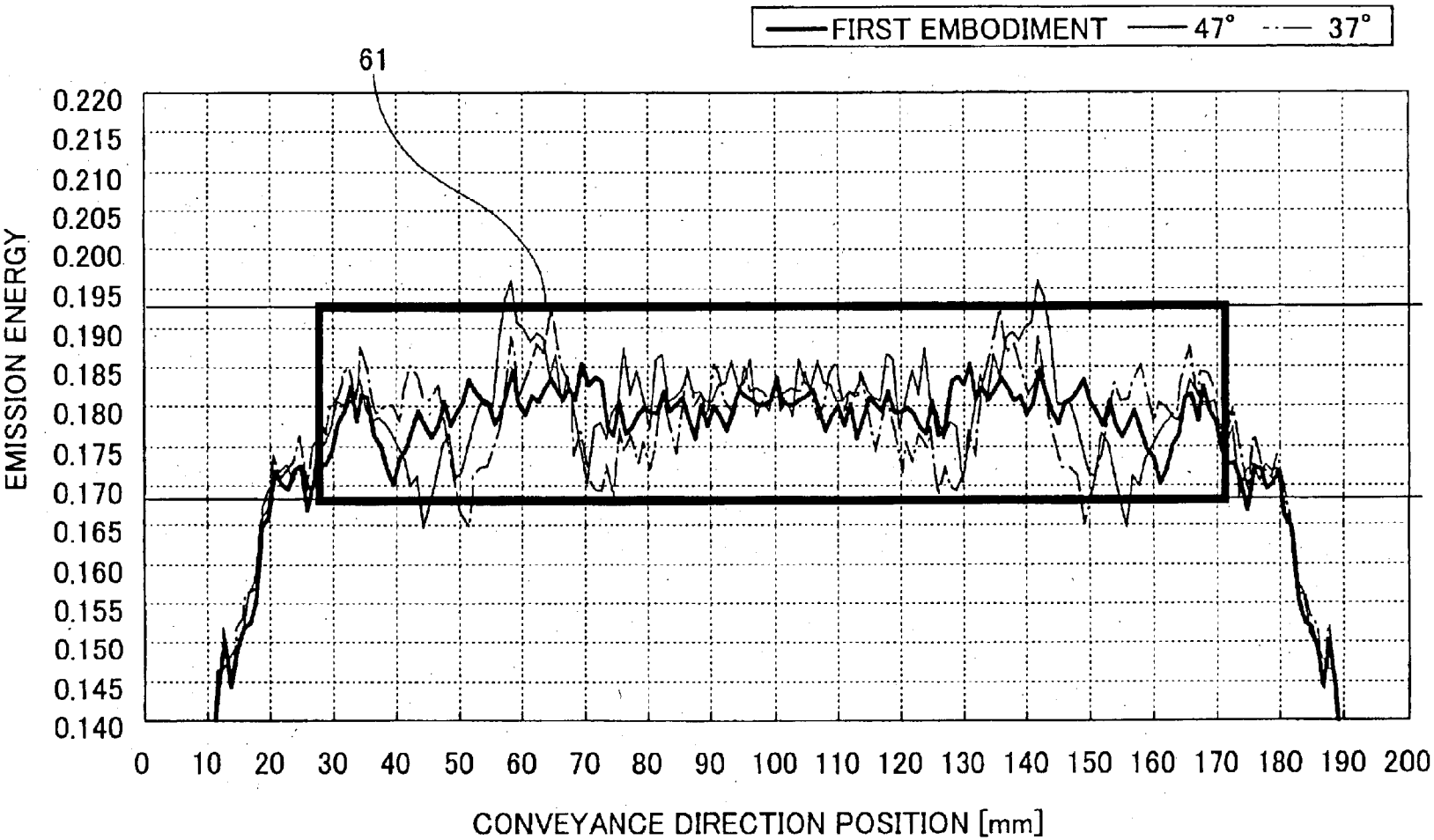
FIG. 18 is a view showing a simulation result by the Monte Carlo method of the emission energy in a case where the acute angle of the side surface board 22*c* is set as "out of the area ±1°"
Figure 19:
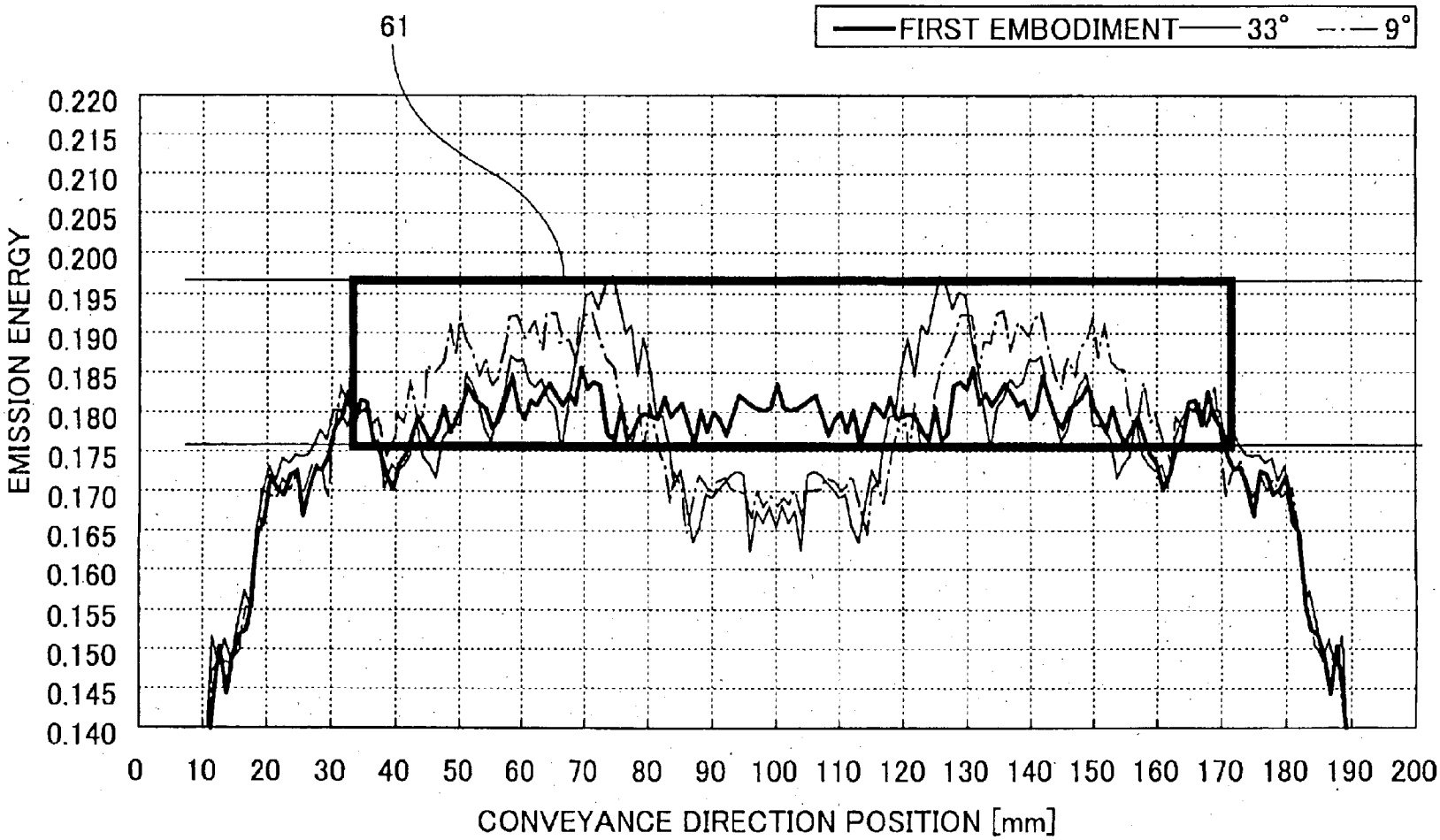
FIG. 19 is a view showing a simulation result by the Monte Carlo method of the emission energy in a case where the acute angle of the side surface board 22*d* is set as "out of the area ±1°"

The same consideration can be given for the result of the simulation shown in FIGS. 17 through 19. FIG. 17 is a view showing a simulation result by the Monte Carlo method of the emission energy in a case where the acute angle of the side surface board 22*b* is set as "out of the area ±1°". FIG. 18 is a view showing a simulation result by the Monte Carlo method of the emission energy in a case where the acute angle of the side surface board 22*c* is set as "out of the area ±1°". FIG. 19 is a view showing a simulation result by the Monte Carlo method of the emission energy in a case where the acute angle of the side surface board 22*d* is set as "out of the area ±1°".

Referring to FIGS. 17 through 19, in a case of deviating from a preferable range of an acute angle of the above described side surface boards 22*a* through 22*d*, the emission energy distribution deviates from the unevenness of light and shade so that an undesirable printing result is obtained.

Figure 20:
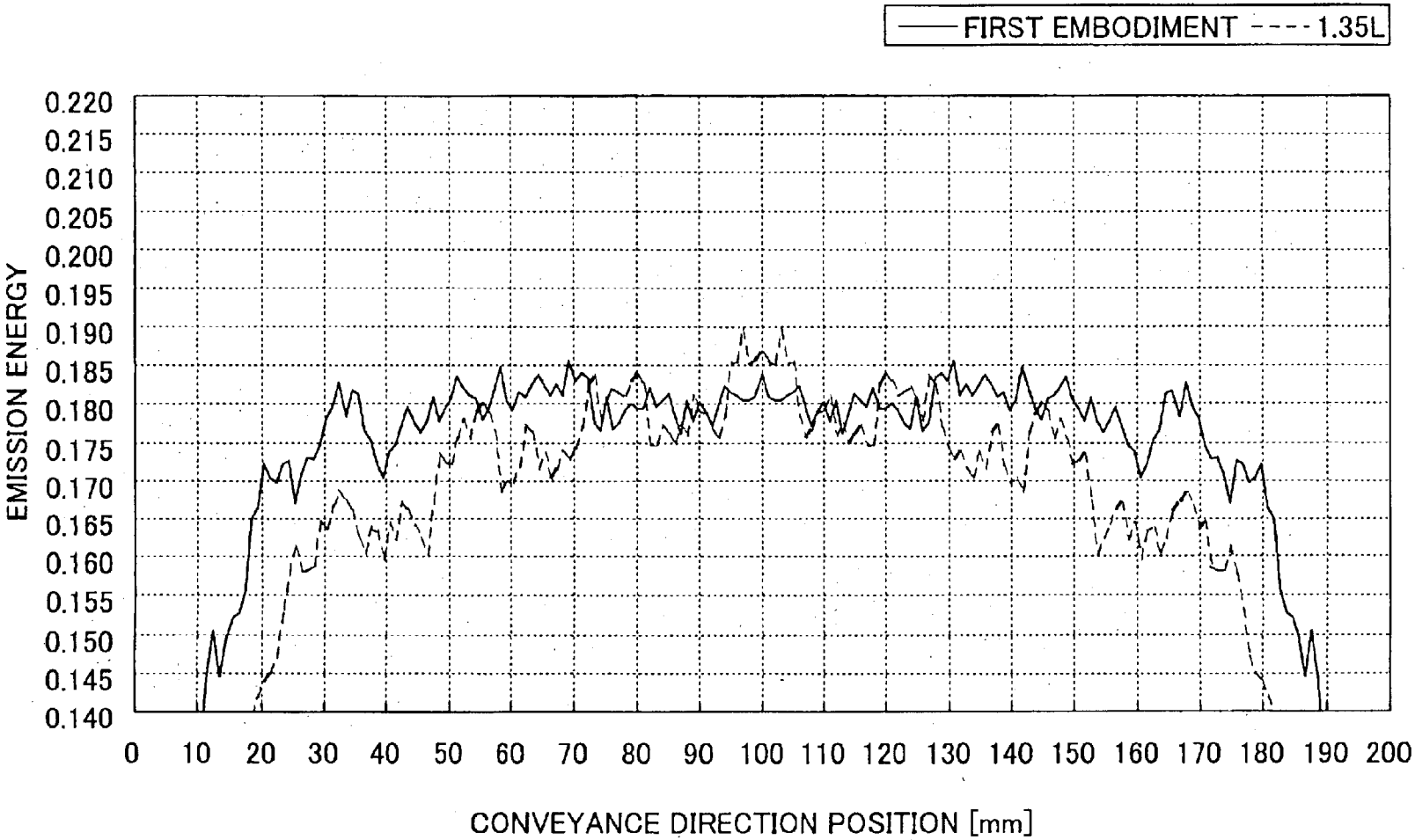
FIG. 20 is a view showing emission energy distribution wherein the external diameter K of the flash lamp circle 40 is 1.35L.

FIG. 20 is a view showing emission energy distribution wherein the external diameter K of the flash lamp circle 40 is 1.35L. In FIG. 20, the emission energy distribution in a case where the external diameter K of the flash lamp circle 40 is larger than L and smaller than 1.3L is shown by a solid line. As shown in FIG. 20, if the external diameter K of the flash lamp circle 40 is set so as to be larger than 1.3L, the emission energy distribution does not have a trapezoid configuration but rather a mountain shape. In this case, it is necessary to set the emission frequency large in order to prevent the unevenness of light and shade. That is a disadvantage for energy consumption.

Figure 21:
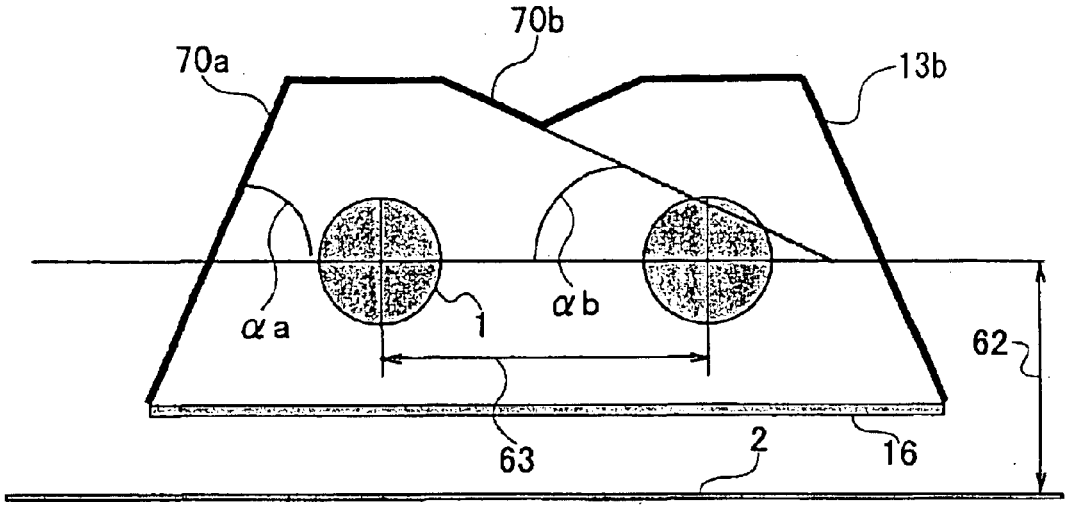
FIG. 21 is a schematic cross sectional view of the flash fixing unit 13*b* of the second embodiment.
Figure 22:
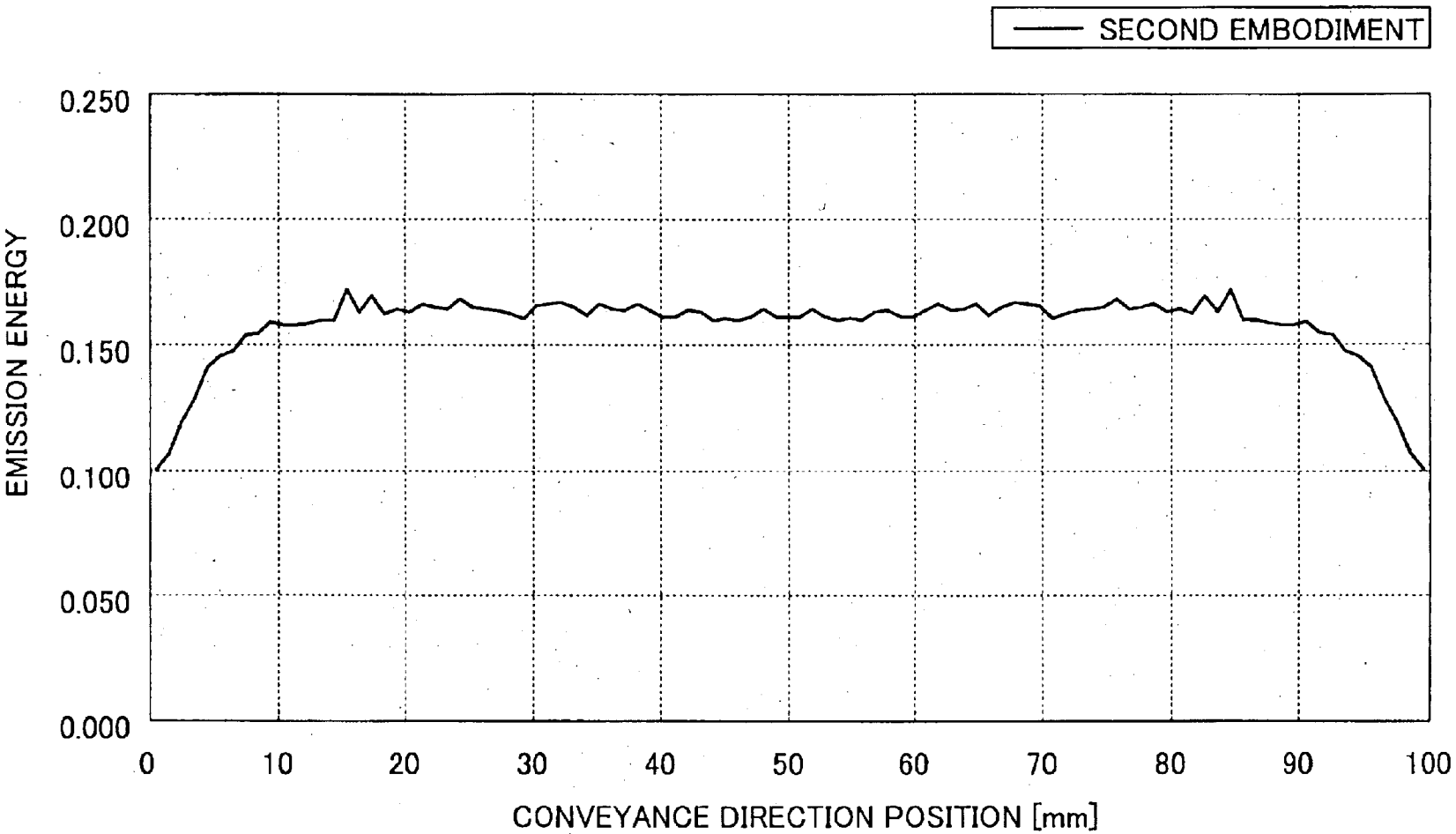
FIG. 22 is a view showing a simulation result of the emission energy distribution in a case where the reflection board of the second embodiment is used.

Next, a flash fixing unit 13 having two flash lamps and a reflection board corresponding to the flash lamps will be described as a second embodiment of the present invention. FIG. 21 is a schematic cross sectional view of the flash fixing unit 13*b* of the second embodiment. FIG. 22 is a view showing a simulation result of the emission energy distribution in a case where the reflection board of the second embodiment is used.

In this embodiment, it is preferable that the acute angle $\alpha_a$ of the side surface board 70*a* be in the same range as the range (63°±4°) of the acute angle $\alpha_a$ of the side surface board 22*a*. It is also preferable that the acute angle $\alpha_b$ of the side surface board 70*b* be 11°±2°. Because of this, it is possible to make a trapezoid type emission energy distribution as shown in FIG. 22. Therefore, even if there are only two flash lamps, it is possible to obtain a picture having no unevenness of light and shade by using a determining method of the emission frequency that is the same as the first embodiment.

Figure 23:
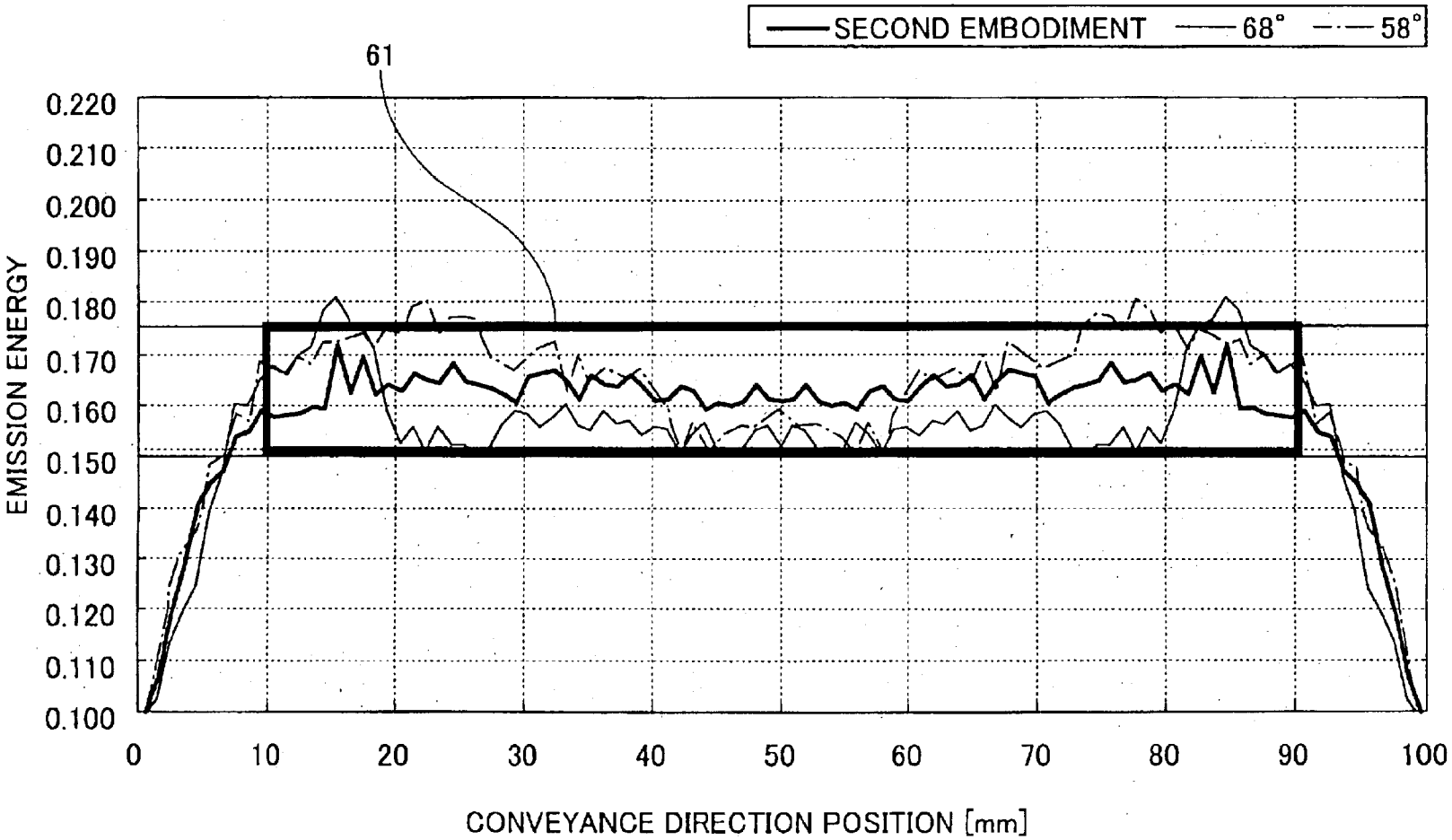
FIG. 23 is a view showing a simulation result of the emission energy distribution in a case where the side surface board 70*a* is in out of area ±1°.
Figure 24:
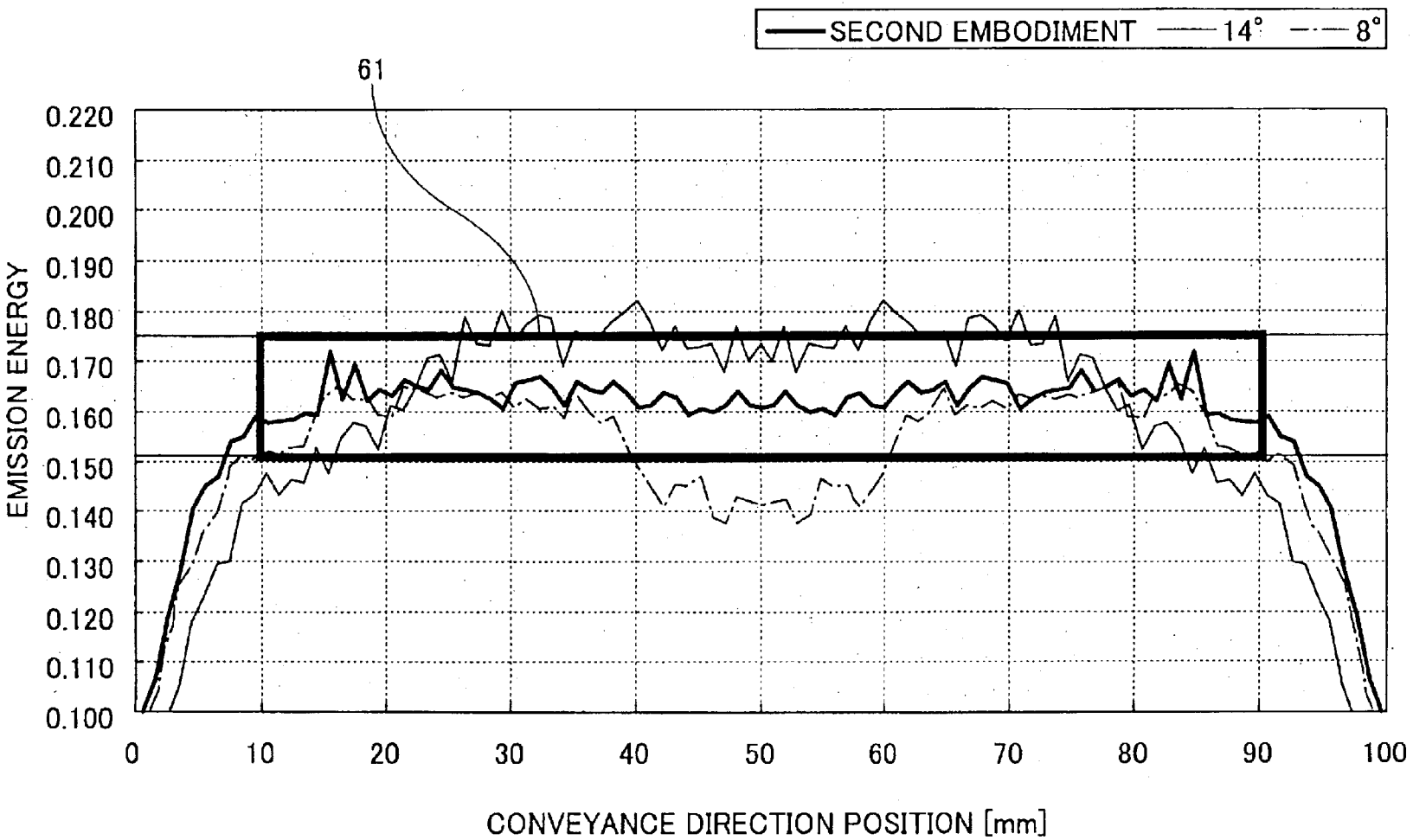
FIG. 24 is a view showing a simulation result of the emission energy distribution in a case where the side surface board 70*b* is in out of area ±1°.

FIG. 23 is a view showing a simulation result by the Monte Carlo method of the emission energy distribution in a case where the side surface board 70*a* is in out of area ±1°. FIG. 24 is a view showing a simulation result by the Monte Carlo method of the emission energy distribution in a case where the side surface board 70*b* is in out of area ±1°. In this case, the emission energy distribution deviates from the one time of unevenness of light and shade allowance area 61 so that undesirable printing result may be generated. In this embodiment, one time of unevenness of light and shade allowance area 61 is defined as a range of ±7% of the formula (4) wherein the central value H (approximately 0.175) is the center.

Figure 25:
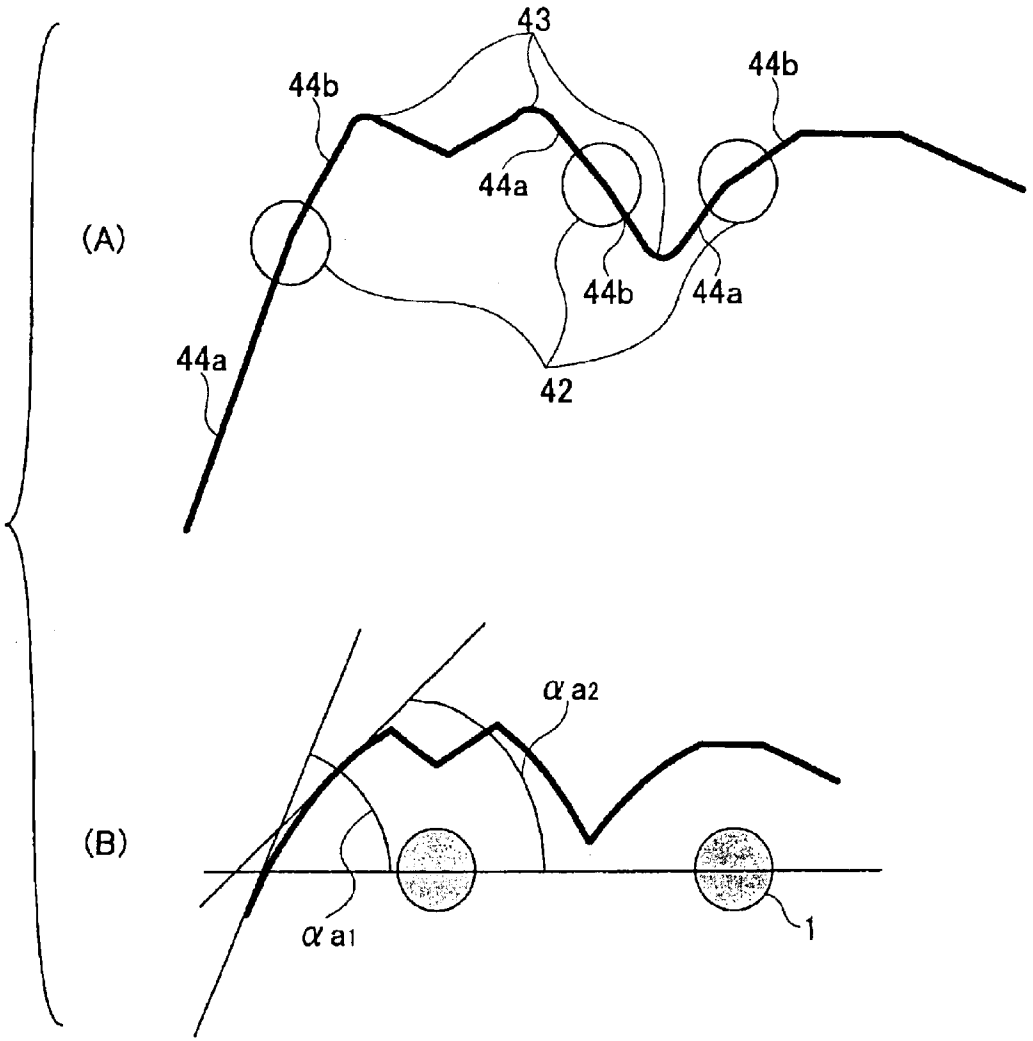
FIG. 25 is a view showing another modified example of the inclination angle of the reflection board of the present invention.

FIG. 25 is a view showing another modified example of the inclination angle of the reflection board of the present invention.

In the above embodiment of the present invention, the preferable inclination angle range of the side surface boards 22*a* through 22*h* of the reflection board 15 is determined based on the side surface boards 22*a* through 22*h* being flat surfaces. However, as shown in FIG. 25-(A), it is possible to form a bending part 42 on the respective side surface boards 22*a* through 22*h*, 70*a*, and 70*b* of the reflection board 15 and modify a bending radius 43 of the side surface board. In this case, it is preferable that the inclination angle of the reflection surface of the side surface board except the bending part 42 be set based on the above mentioned preferable inclination range. Furthermore, it is preferable that the reflection surface 44*b* of the side surface board in a central part direction against the bending part 42 have a smaller inclination angle than the reflection surface 44*a*.

Furthermore, as shown in FIG. 25-(B), it is possible to form the respective side surface boards 22*a* through 22*h*, 70*a*, and 70*b* of the reflection board 15 by a curved surface. In this case, it is preferable that acute angles $\alpha_{a1}$, $\alpha_{a2}$, . . . formed by the tangential lines of the curved surfaces and the standard line BL be set based on the above mentioned preferable inclination angle range. The acute angles $\alpha_{a1}$, $\alpha_{a2}$, . . . are preferably set as $\alpha_{a1}>\alpha_{a2}>$ . . . . That is, as a position is closer to the center of the irradiation in a conveyance direction of the continuous-form paper 2, the acute angle of the position is lower.

Although the continuous-form paper is used as a printing medium in the above embodiments, the present invention is not limited to the continuous-form paper but can be applied to flat sheets.

It is possible to prevent the flat sheet from having the unevenness of the light and the shade by the trapezoid type one time flash emission energy distribution according to the present invention without overlapping the flash light.

That is, it is possible to obtain the printing result not having the unevenness of light and shade without overlapping the flash light in a case the length in the conveyance direction of the flat sheet is smaller than the above mentioned central part (one flash part).

The "side surface board" in the above mentioned embodiments corresponds to the "side part reflection surface" in the following claims. The "top surface board" in the above mentioned embodiments corresponds to the "upper part reflection surface" in the following claims.

Furthermore, the "side" or "side part" in the following claims should be interpreted as a direction perpendicular to the central axes of the two flash lamps arranged at respective ends, for example. The "upper" and "upper part" in the following claims should be interpreted as a direction perpendicular to the standard surface that is opposite to the direction of the recording medium against the standard surface.

The present invention is not limited to these embodiments, but variations and modifications may be made without departing from the scope of the present invention.

This patent application is based on Japanese priority patent application No. 2001-055735 filed on May 15, 2001, the entire contents of which are hereby incorporated by reference.

What is claimed is:

1. A flash fixing device configured to fix a toner image by a flash light, comprising:

(1) an alignment of flash lamps, comprising:

(i) a first flash lamp having a first central axis, provided at one end of the alignment;

(ii) a second flash lamp having a second central axis, provided at the other end of the alignment, wherein the second flash lamp is parallel to the first flash lamp, wherein a surface including the first flash lamp and the second flash lamp forms a standard surface; and (iii) a third flash lamp provided between the first and the second flash lamps, parallel to the first and the second flash lamps, wherein the alignment of the flash lamps has a center; and (2) a reflection board provided above the alignment, comprising:

(i) a first pair of side part reflection surfaces, provided along the first flash lamp;

(ii) a second pair of side part reflection surfaces, provided along the second flash lamp; and (iii) a third pair of side part reflection surfaces, provided along the third flash lamp, wherein each of the side part reflection surfaces reflects downward a light emitted from each of the flash lamps; and wherein an acute angle formed between the standard surface and each of the side part reflection surfaces becomes smaller as the acute angle is positioned closer to the center of the alignment of the flash lamps.

2. The flash fixing device as claimed in claim 1, wherein each of the side part reflection surfaces of the reflection board is substantially flat.

3. The flash fixing device as claimed in claim 1, wherein shortest distances between the first central axis of the first flash lamp and the first pair of the side part reflection surfaces are substantially the same.

4. The flash fixing device as claimed in claim 3, wherein the shortest distances are larger than a maximum length in a case where a leak electric current can occur between the first flash lamp and the first pair of the side part reflection surfaces, and are smaller than 1.3 times of the maximum length.

5. The flash fixing device as claimed in claim 3, wherein the shortest distances are larger than a maximum length in a case where a leak electric current can occur between the second flash lamp and the second pair of the side part reflection surfaces, and are smaller than 1.3 times of the maximum length.

6. The flash fixing device as claimed in claim 3, wherein the shortest distances are larger than a maximum length in a case where a leak electric current can occur between the third flash lamp and the third pair of the side part reflection surfaces, and are smaller than 1.3 times of the maximum length.

7. The flash fixing device as claimed in claim 1, wherein shortest distances between the second central axis of the second flash lamp and the second pair of the side part reflection surfaces are substantially the same.

8. The flash fixing device as claimed in claim 1, wherein shortest distances between the central axis of the third flash lamp and the third pair of the side part reflection surfaces are substantially the same.

9. The flash fixing device as claimed in claim 1, wherein the reflection board further includes:

(iv) a first upper part reflection surface, provided above and along the first flash lamp;

(v) a second upper part reflection surface, provided above and along the second flash lamp; and (iv) a third upper part reflection surface, provided above and along the third flash lamp, wherein the first upper part reflection surface and/or the second upper part reflection surface have/has a convex portion when seen from the first central axis and/or the second central axis.

10. The flash fixing device as claimed in claim 1, further comprising a control part for controlling the emission of the flash lamps moving relatively against an irradiation area, wherein the control part controls the emission of the flash lamps with an emission frequency where energy is applied, by which energy a toner starts fixing to a substantially end part of a central part if the irradiation area based on the following flash light.

11. A flash fixing device configured to fix a toner image by a flash light, comprising:

a plurality of flash lamps in an arrangement parallel to each other; and a reflection board including a plurality of side part reflection surfaces each facing from a side to the respective flash lamps, wherein in a case where a surface including two central axes of the flash lamps at both ends of the arrangement is defined as a standard surface, an acute angle against the standard surface is set to be decreased as the side part reflection surface is positioned closer to a center of the arrangement of the plurality of the flash lamps;

wherein the reflection board further includes an upper part reflection surface facing against the flash lamps; and wherein the upper part reflection surface corresponding to one of the flash lamps at an end of the arrangement has a convex configuration as seen from the central axis of the flash lamp.

12. A flash fixing device configured to fix a toner image by a flash light, comprising:

a plurality of flash lamps in an arrangement parallel to each other;

a reflection board including a side part reflection surface and an upper part reflection surface that partially surround the flash lamp, as corresponding to the respective flash lamps, so that a light emitted by the flash lamps is reflected to an irradiation area; and a control part for controlling the emission of the flash lamps moving relatively against an irradiation area, wherein an emission energy distribution obtained by a one time flash light of the flash lamps is substantially constant at a central part of the irradiation area and decreases gradually from the central part to both end parts of the irradiation area, wherein the control part controls the emission of the flash lamps with an emission frequency where energy is applied, by which energy a toner starts fixing to a substantially end part of a central part if the irradiation area based on the following flash light.

13. A flash fixing device configured to fix a toner image by a flash light, comprising:

a plurality of flash lamps in an arrangement parallel to each other;

a reflection board including a plurality of side part reflection surfaces each facing from a side to the respective flash lamps; and a control part for controlling the emission of the flash lamps moving relatively against an irradiation area, wherein in a case where a surface including two central axes of the flash lamps at both ends of the arrangement is defined as a standard surface, an acute angle against the standard surface is set to be decreased as the side part reflection surface is positioned closer to a center of the arrangement of the plurality of the flash lamps, wherein the control part controls the emission of the flash lamps with an emission frequency where energy is applied, by which energy a toner starts fixing to a substantially end part of a central part if the irradiation area based on the following flash light.

14. A flash fixing device configured to fix a toner image by a flash light, comprising:

(1) an alignment of flash lamps, comprising:

(i) a first flash lamp having a first central axis, provided at one end of the alignment;

(ii) a second flash lamp having a second central axis, provided at the other end of the alignment, wherein the second flash lamp is parallel to the first flash lamp, wherein a surface including the first flash lamp and the second flash lamp forms a standard surface; and (iii) a third flash lamp provided between the first and the second flash lamps, parallel to the first and the second flash lamps, wherein the alignment of the flash lamps has a center; and (2) a reflection board provided above the alignment, comprising:

(i) a first pair of side part reflection surfaces, provided along the first flash lamp;

(ii) a second pair of side part reflection surfaces, provided along the second flash lamp; and (iii) a third pair of side part reflection surfaces, provided along the third flash lamp;

wherein each of the side part reflection surfaces reflects a light emitted from each of the flash lamps to an irradiation area;

wherein an emission energy distribution obtained by a one time flash light of the flash lamps is substantially constant at a central part of the irradiation area and decreases gradually from the central part to both end parts of the irradiation area.

15. The flash fixing device as claimed in claim 14, further comprising a control part for controlling the emission of the flash lamps moving relatively against an irradiation area, wherein the control part controls the emission of the flash lamps with an emission frequency where energy is applied, by which energy a toner starts fixing to a substantially end part of a central part if the irradiation area based on the following flash light.

16. A printing device configured to form a toner image of a medium carried at a designated conveyance speed, comprising:

(I) image forming means for forming the toner image at the medium; and (II) a flash fixing device configured to fix the toner image by a flash light, comprising:

(1) an alignment of flash lamps, comprising:

(i) a first flash lamp having a first central axis, provided at one end of the alignment;

(ii) a second flash lamp having a second central axis, provided at the other end of the alignment, wherein the second flash lamp is parallel to the first flash lamp, wherein a surface including the first flash lamp and the second flash lamp forms a standard surface; and (iii) a third flash lamp provided between the first and the second flash lamps, parallel to the first and the second flash lamps, wherein the alignment of the flash lamps has a center; and (2) a reflection board provided above the alignment, comprising:

(i) a first pair of side part reflection surfaces, provided along the first flash lamp;

(ii) a second pair of side part reflection surfaces, provided along the second flash lamp; and (iii) a third pair of side part reflection surfaces, provided along the third flash lamp, wherein each of the side part reflection surfaces reflects downward a light emitted from each of the flash lamps;

wherein an acute angle formed between the standard surface and each of the side part reflection surfaces becomes smaller as the acute angle is positioned closer to the center of the alignment.

* * * * *